US006443107B1

(12) United States Patent
Mendler

(10) Patent No.: US 6,443,107 B1
(45) Date of Patent: Sep. 3, 2002

(54) RIGID CRANKSHAFT CRADLE AND ACTUATOR

(76) Inventor: Edward Charles Mendler, 3522 Northampton St., NW., Washington, DC (US) 20015

( * ) Notice: Subject to any disclaimer, the term of this patent is extended or adjusted under 35 U.S.C. 154(b) by 0 days.

(21) Appl. No.: 09/700,574

(22) PCT Filed: May 27, 1999

(86) PCT No.: PCT/US99/11716

§ 371 (c)(1),
(2), (4) Date: Nov. 16, 2000

(87) PCT Pub. No.: WO99/61766

PCT Pub. Date: Dec. 2, 1999

(51) Int. Cl.[7] ..... F02B 75/04
(52) U.S. Cl. ..... 123/48 B; 123/78 F
(58) Field of Search ..... 123/78 R, 78 F, 123/48 R, 48 B, 48 D, 197.4

(56) References Cited

U.S. PATENT DOCUMENTS

| | | | | |
|---|---|---|---|---|
| 741,179 A | | 10/1903 | Sproehnle | |
| 887,633 A | | 5/1908 | Heginbottom | |
| 936,409 A | | 10/1909 | Chapman | |
| 1,160,940 A | | 11/1915 | Momo | |
| 1,715,368 A | | 6/1929 | Jaussaud | |
| 1,872,856 A | | 8/1932 | Walker | |
| 2,357,031 A | | 8/1944 | Stabler | |
| 2,433,639 A | | 12/1947 | Woodruff et al. | |
| 2,589,958 A | | 3/1952 | Petit | |
| 2,770,224 A | | 11/1956 | Ericson | |
| 3,633,552 A | | 1/1972 | Huber | |
| 3,961,607 A | * | 6/1976 | Brems | 123/78 R |
| 4,195,613 A | | 4/1980 | Bratt et al. | |
| 4,738,230 A | | 4/1988 | Johnson | |
| 4,860,702 A | | 8/1989 | Doundoulakis | |
| 5,215,051 A | * | 6/1993 | Smith | 123/197.4 |
| 5,562,068 A | * | 10/1996 | Sugimoto et al. | 123/48 B |
| 5,572,959 A | | 11/1996 | Hedelin | |
| 5,605,120 A | | 2/1997 | Hedelin | |
| 5,611,301 A | | 3/1997 | Gillbrand et al. | |
| 6,247,430 B1 | * | 6/2001 | Yapici | 123/78 F |

FOREIGN PATENT DOCUMENTS

| | | |
|---|---|---|
| DE | 3127760 | 3/1983 |
| DE | 3644721 A1 | 7/1988 |
| EP | 0 345 366 A1 | 12/1989 |
| EP | 0 426 540 A1 | 10/1990 |
| EP | 0 560 701 A1 | 2/1993 |
| FR | 440863 | 3/1912 |
| GB | 20326 | 9/1906 |
| GB | 13152 | 6/1907 |
| JP | 55 64131 | 5/1980 |
| WO | WO92/09799 | 6/1992 |
| WO | WO97/36096 | 10/1997 |

OTHER PUBLICATIONS

Doglas et al., An Experimental Single Cylinder ECCLINK VCR Engline, SAE paper No. 921695, pub 1992.
Larson, "Research Engine for Evaluating the Effects of Variable Compression Ratio. . ." SAE paper No. 910053, pub. 1991.
Wirbeleit et al., "Development of Pistons with Variable Compression Height. . ." SAE paper No. 900229, pub. 1990.
Wallace et al., "A Variable Compression Ratio Engine Development" SAE paper No. 762A, pub. Oct. 1963.

* cited by examiner

*Primary Examiner*—Marguerite McMahon

(57) ABSTRACT

Crankshaft main bearing failure in variable compression ratio engines having eccentric main bearing supports is prevented by rigidly supporting the bearings in a crankshaft cradle. The crankshaft cradle is rotatably mounted in the engine on a first axis, and the crankshaft is mounted in the crankshaft cradle on a second axis off-set from the first axis. The crankshaft cradle comprises eccentric members that support the bearing elements, and structural webbing that rigidly hold the eccentric members in alignment with one another at all times. Bearing caps and fasteners rigidly and removably secure the crankshaft in the crankshaft cradle. An actuator rotates the crankshaft cradle and adjusts the position of the crankshaft axis of rotation and the compression ratio of the engine. The crankshaft cradle rigidly holds the main bearings in precise alignment at all times and provides long bearing life.

29 Claims, 11 Drawing Sheets

FIG. 1
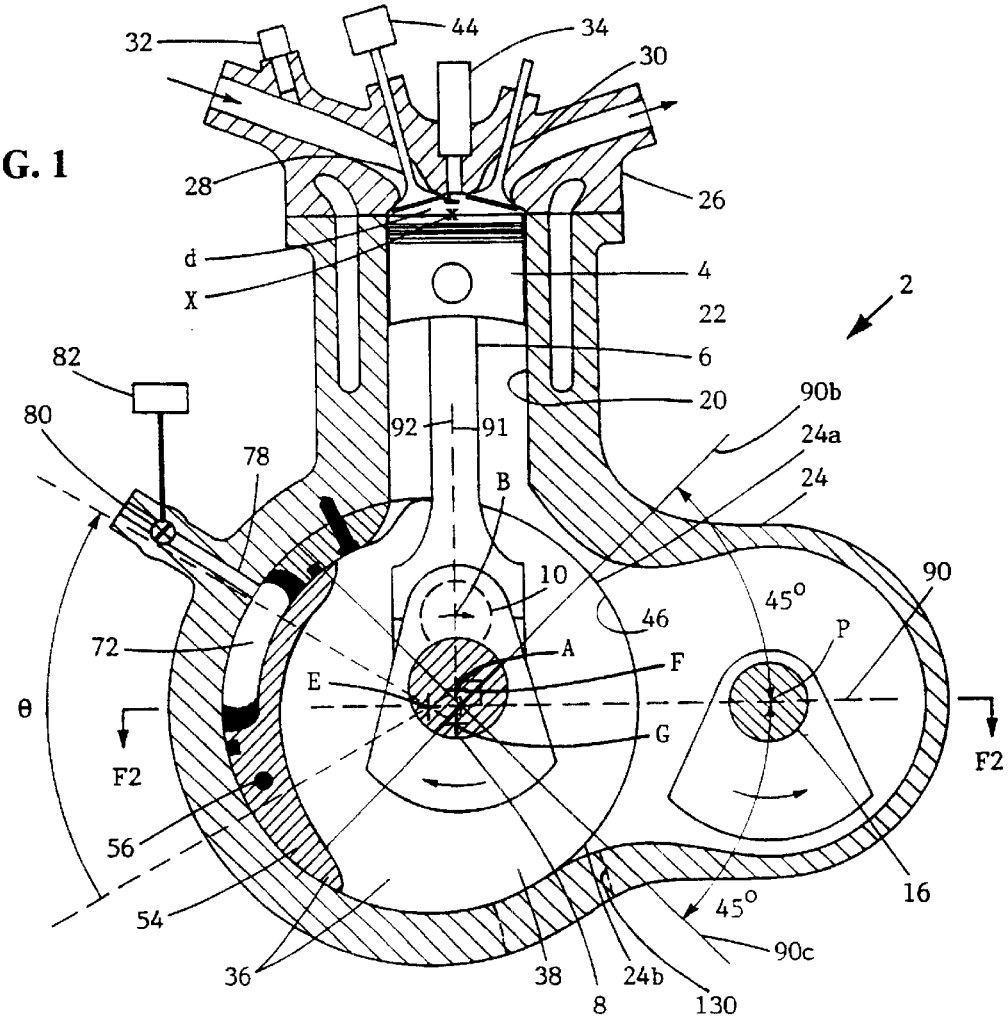
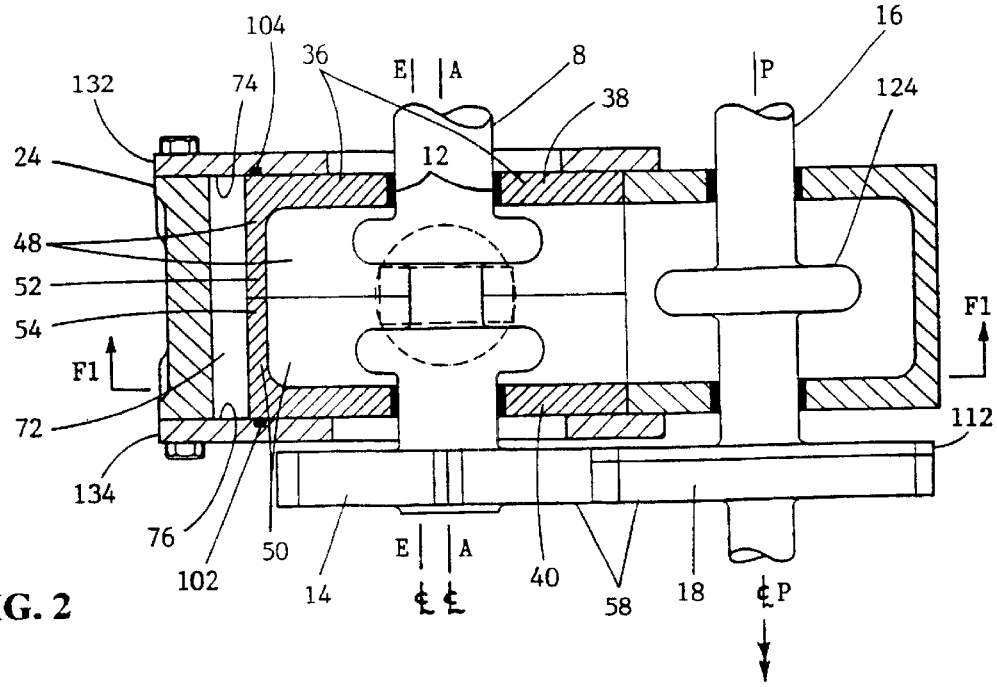
FIG. 2

RIGID CRANKSHAFT CRADLE AND ACTUATOR

BACKGROUND OF THE INVENTION

The present invention relates to a method and apparatus for adjusting the compression ratio of internal combustion engines, and more specifically to a method and apparatus for adjusting the position of the crankshaft with eccentric crankshaft main bearing supports.

Designs for engines having eccentric crankshaft main bearing supports have been known for sometime. In these engines the eccentric main bearings are rotated to adjust the position of the crankshaft's axis of rotation. Poor rotational alignment of the eccentric main bearing supports is a problem for these engines because even small amounts of main bearing misalignment can cause rapid main bearing failure.

Significant forces bear down on the eccentric main bearing supports during operation of the engine. In modern passenger car engines main bearing loads can exceed 50 MPa. The forces exerted on the eccentric main bearing supports are at times significantly different from one eccentric main bearing support to the next. For example, in multi-cylinder engines a clockwise torque may be applied on a first eccentric main bearing support from the combustion pressure bearing down on the first piston, connecting rod and crank throw, and a counterclockwise torque may be applied on a second or third eccentric main bearing support from the inertial forces of the second piston and connecting rod pulling up on the second crank throw. As a second example, in a single cylinder engine having two eccentric main bearing supports the torque applied to the crank throw and the resistive torque at the power take off end of the crankshaft cause uneven loading on the eccentric main bearing supports. These large unequal forces are a problem because they cause the eccentric sections to rotate out of alignment with one another causing rapid failure of the crankshaft main bearings.

In U.S. Pat. No. 887,633, and in German patent DE 3644721 A1 a pinned linkage is show for adjusting the rotational alignment of the eccentric main bearing sections. U.S. Pat. No. 4,738,230 shows dowels extending from each eccentric main bearing support that are fitted into slots located in a slidable bar for adjusting the rotational alignment of the eccentric main bearing supports. U.S. Pat. Nos. 5,572,959 and 5,605,120 show gear teeth extending from eccentric main bearing supports that engage a layshaft with mating gears for adjusting the rotational alignment of the eccentric main bearing supports. U.S. Pat. No. 1,160,940 shows a bail shaped frame that connects adjacent eccentric sections for adjusting the rotational alignment of the eccentric sections. Poor alignment of the main bearings is a significant problem for each of these systems. In addition to poor main bearing alignment a number of these systems are not mechanically functional for other reasons, are impractical for mass production manufacture and assembly, and/or are not functional for engines having more than two main bearings. For example, U.S. Pat. No. 1,160,940 shows a bail shaped frame that is weakly connected to the eccentrics and that does not have a rigid construction. In addition to not rigidly hold the bearings in alignment. the system is not mechanically functional because the connecting rod does not clear the bail shaped frame. The system is also not functional for engines having more than two main bearings because it is not possible to slide the eccentric main bearing support onto the center crankshaft journal or journals.

A further problem with engines having rotatable eccentric main bearing supports in a fixed engine housing is that the location of the crankshaft rotational axis changes with change of compression ratio, making use of a conventional in-line clutch impossible. Geared power take-off couplings for engines having an adjustable crankshaft rotational axis are shown in the prior art, however a problem with these systems is that heavy structural reinforcing is required to rigidly hold the gear set in alignment. In addition to the problem of added weight, engine housing length is also increased.

German patent DE 3644721 A1 shows a gear set mounted to the free end of one of the eccentric crankshaft main bearing supports. The gear set has an intermediary shaft and an output shaft. The output shaft points generally away from the crankshaft, and has a fixed axis of rotation for all compression ration settings. A problem with the system shown in German patent DE 3644721 A1 is that during periods of high engine torque the end eccentric main bearing support may bend out of alignment, resulting in damage to the crankshaft main bearing. The gear set is also bulky and increases cranktrain friction losses due to the increased number of bearings and gear friction. U.S. Pat. No. 4,738.230 shows a first spur gear mounted on the crankshaft and a second spur gear having an axis of rotation that is concentric with the axis of rotation of the main bearing supports. These gears are too small to carry the torsional loads of the engine. U.S. Pat. No. 4,738,230 also shows a power take-off system having an internal or annular gear set. Heavy and lengthy structural reinforcing is required for holding the ring gear shaft in rigid alignment with the gear mounted on the end of the crankshaft. U.S. Pat. Nos. 5,443,043, 5,572,959 and 5,605,120 show a crankshaft having a fixed axis of rotation and an upper engine that changes position relative to its supporting frame when the compression ratio is changed. While a conventional in-line clutch can be employed with this arrangement, the position of the upper engine is changed when the compression ratio is changed, and the inertial mass of the upper engine prevents rapid adjustment of compression ratio.

SUMMARY OF THE INVENTION

In the present invention, a rotatable rigid crankshaft cradle is employed for holding the crankshaft main bearings in alignment. The crankshaft cradle is rotatably mounted in the engine on a pivot axis, and the crankshaft is mounted in the crankshaft cradle on a second axis off-set from the pivot axis. An actuator rotates the crankshaft cradle and adjusts the position of the crankshaft axis of rotation and the compression ratio of the engine. The crankshaft cradle rigidly holds the main bearings in precise alignment at all times and provides long bearing life. The crankshaft cradle provides rigid support of crankshafts for single and multi-cylinder engines, ranging from crankshafts having two main bearings for single and two cylinder engines, to crankshafts having five or more main bearings for in-line-four cylinder engines, V8 engines, as well as other engines. In addition to providing a long main bearing life, the variable compression ratio mechanism of the present invention is reliable and has a low cost.

Referring now to FIGS. 3, 4 and 5, in the preferred embodiment of the present invention a crankshaft cradle 60 is rotatably mounted in the engine housing on a pivot axis E, and a crankshaft 61 is mounted in the crankshaft cradle on a second axis A off-set from the pivot axis. The cradle includes two or more main bearing supports or eccentric members 62 and structural webbing 64 for rigidly holding the eccentric members and main bearings in alignment. One or more bearing caps 68 are fastened to the cradle with bolts or another type of fastener for securing the crankshaft in the cradle. The bearing caps are removable from the cradle permitting assembly of the crankshaft in the cradle. Operation of the main bearings without failure requires precise alignment of the main bearing supports at all times. According to the present invention, adjacent main bearing supports are held in rigid alignment at all times by structural webbing 64. More specifically. the structural webbing holds the main bearing supports in rigid alignment at all times providing a long service life for the main bearings.

FIG. 9 shows a second embodiment of the present invention. As shown in FIG. 9, crankshaft cradle 146 includes a first eccentric member, or main bearing support 160 and a second eccentric member, or main bearing support 162. The crankshaft cradle is assembled by sliding main bearing support 160 over a first end of crankshaft 152, and sliding the second main bearing support 162 over the second end of crankshaft 152 and rigidly fastening the main bearing supports together with one or more bolts 164. The main bearing supports include structural webbing for rigid attachment of the first main bearing support to the second main bearing support. The crankshaft applies large loads on main bearings 12, and the assembled crankshaft cradle 146 holds main bearings 12 in precise alignment under the high load conditions and more generally crankshaft cradle 146 holds main bearings 12 in precise alignment at all times.

An actuator first adjusts the rotational position of the crankshaft cradle about its pivot axis, and then locks the rotational position of the cradle in place. The actuator applies force on the cradle at a central location between the main bearings, and more generally between the front and back eccentric members, whereby twisting of the crankshaft cradle and miss alignment of the main bearings is minimized. Accordingly, the eccentric members are rigidly maintained in alignment providing a long main bearing life. Another advantage of the present invention is that the cradle has a small inertial mass, and the actuator can adjust compression ratio settings rapidly.

Power is transferred from the crankshaft to the power take-off shaft through gears 14 and 18. According to the present invention, gears 14 and 18 have a variable centerline distance and a variable backlash value. According to the present invention, the power take-off shaft is positioned to provide a small maximum gear backlash value for a large change in compression ratio. The power take-off coupling of the present invention provides long gear life exceptional reliability, low noise levels, and a low cost.

According to the present invention, the power takeoff shaft is located within ±45° of an imaginary first plane and preferably within ±33°. The first plane passes through the crankshaft cradle pivot axis E and is perpendicular to the translation axis or centerline axis of the piston(s), providing a small change in backlash from one compression ratio setting to the next. More specifically, location of the power shaft within ±45° of the first plane, and preferably within +33°, provides a small gear backlash, low gear noise, and long gear life. Additionally, gears 14 and 18 are mounted on parallel shafts and preferably have helical involute teeth permitting operation of the gears with small variations in centerline distance. Gears 14 and 18 are of automotive quality and have a diameter and width that provides a long gear life.

Prolonged operation of gears 14 and 18 without failure requires maintenance of parallel alignment of gear 14 and gear 18. According to the present invention, the crankshaft cradle holds the bearing elements the crankshaft, and gear 14 in precise parallel alignment at all times with the power take-off shaft and gear 18. According to the present invention, high structural loads are applied by the crankshaft on the bearing elements, and the crankshaft cradle rigidly holds the main bearing supports in precise parallel alignment at all times preventing failure of the bearing elements and preventing failure of gears 16 and 18.

The power take-off shaft is located adjacent to crankshaft cradle in the engine housing, and is rigidly supported with only a minimal increase of engine size and weight. A further advantage of the present invention is that the power take-off shaft may also serves as a balance shaft. FIG. 9 shows an embodiment of the present invention where the power take-off shaft also serves as a balance shaft for the engine. The engine shown in FIG. 9 has a small size and low bearing and gear friction in part because balancing and power take-off is accomplished with a single shaft.

Referring now to FIGS. 3, 4, 5 and 9, gear 14 mounted on the crankshaft transfers power from the crankshaft to a second gear 18 mounted on the power take-off shaft mounted in the engine housing. The crankshaft rotates on axis A and the power take-off shaft rotates on axis P Axis A and axis P are separated by a centerline distance. According to the present invention, rotation of the crankshaft cradle on the pivot axis E adjusts the position of the crankshaft, adjusts the compression ratio of the engine, and changes the centerline distance between axis A and axis P, causing the backlash clearance between gear 14 and gear 18 to change. According to the present invention, a small maximum gear backlash value is provided by locating the axis of rotation of gear 18 on or near a plane that passes through the axis of rotation of the crankshaft and that is generally perpendicular to the line of translation or centerline of the first piston(s).

The power take-off arrangement according to the present invention is significantly smaller, lighter, and less costly than prior art systems for engines having eccentric main bearing supports. Additionally, the present invention provides a low friction, compact, and light weight combined balance shaft and power takeoff gear set. The variable compression ratio mechanism according to the present invention holds the crankshaft main bearings in rigid alignment and provides a long bearing life. More specifically, the rigidity of the crankshaft cradle holds the bearings in alignment and prevents damage caused by bearing misalignment and vibration. The present invention is reliable and durable. The present invention can be manufactured using standard materials and mass-production methods, and has a low cost. Another advantage of the present invention is that the main bearings can be line bored, according to current manufacturing practices, to establish precise main bearing alignment. The variable compression ratio mechanism has a small inertial mass and a fast response providing rapid change of compression ratio.

BRIEF DESCRIPTION OF THE FIGURES

FIG. 1 shows a section of the variable compression ratio engine according to the present invention. FIG. 1 also shows sectional view F1—F1 of FIG. 2.

FIG. 2 shows sectional view F2—F2 of FIG. 1. FIG. 2 shows the crankshaft, cradle, power shaft, and power output coupling.

FIG. 9 also shows a partial sectional view of engine 136 taken along cut lines F9—F9 shown in FIG. 8.

RIGID CRANKSHAFT CRADLE AND ACTUATOR

Figure 3:
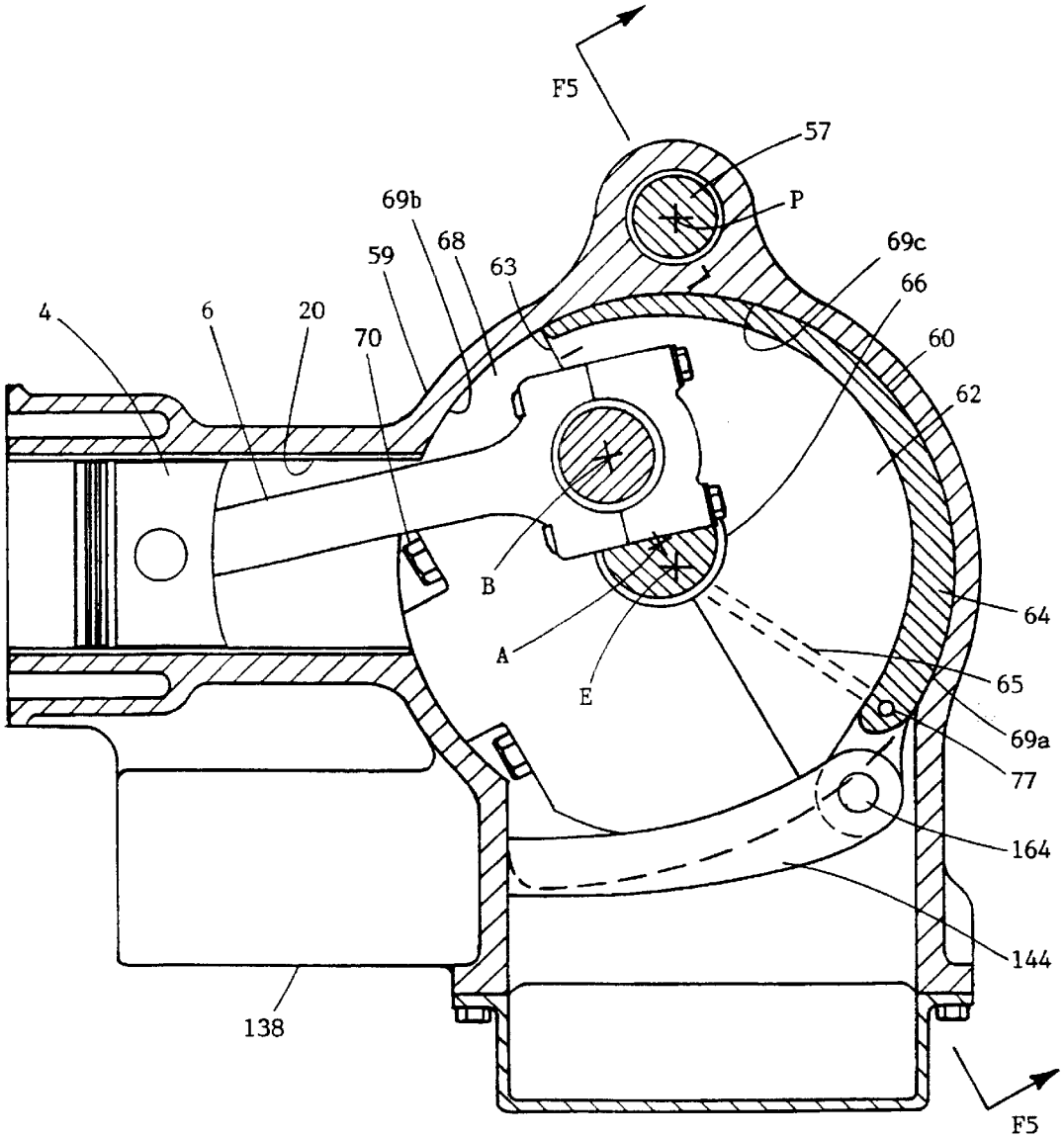
FIG. 3 shows a three cylinder engine according to the present invention.

FIGS. 1 and 2 show a portion of a variable compression ratio engine 2 according to the present invention. Engine 2 has a piston 4, a connecting rod 6, a crankshaft 8 having a crankshaft rotational axis A and having one or more crank throws or cranks 10 having a crank throw centerline B, crankshaft main bearings 12, a crankshaft power take-off gear or output gear 14, a power shaft 16 having a power shaft rotational axis P preferably parallel to crankshaft axis A, a power input gear or power shaft gear 18, a cylinder 20 having cooling means such as a water jacket 22, a housing 24, a cylinder head 26, one or more intake valves 28, one or more exhaust valves 30, fuel injection or carburetion means 32, and one or more spark plugs 34. Crank 10 has a stroke 2L equal to twice the distance from axis A to axis B. Crankshaft 8 is rotatably mounted in a ridged crankshaft cradle 36 having one or more eccentrics such as eccentrics 38 and 40. According to the present invention, engine 2 includes an actuator 42 (shown in FIG. 6) for adjusting the rotational position of a crankshaft cradle 36 on a crankshaft cradle axis or pivot axis E, and for adjusting the position of crankshaft rotational axis A relative to housing 24. More specifically, the cradle is mounted in the engine for pivoting relative to the engine about the pivot axis, the pivot axis is preferably substantially parallel to and spaced from the rotational axis of the crankshaft, and the actuator varies the position of the cradle about the pivot axis, and adjusts the compression ratio of the engine. According to the present invention actuator 42 may be a hydraulic actuator, an electromechanical actuator. a rotary actuator, a straight hydraulic cylinder actuator, or another type of actuator. Preferably, engine 2 is a four-stroke port fuel injected spark-ignition engine. Those skilled in the art will appreciate that according to the present invention engine 2 may be a direct fuel injection spark-ignition engine, a diesel engine, a two-stroke engine, or another type of reciprocating piston engine or variable volume machine such as a Stirling engine, a steam engine, a pump, a compressor, or an expander (all not shown), and that other effective arrangements of valving, fuel supply and ignition means may be provided and/or omitted. Those skilled in the art will appreciate that housing 24 and cylinder head 26 may be separable, a single cast part, or other functional arrangement. Piston 4 is slidably housed in cylinder 20 which is provided air through intake valve 28. Intake valve 28 may include an adjustable valve actuation mechanism 44.

Figure 7:
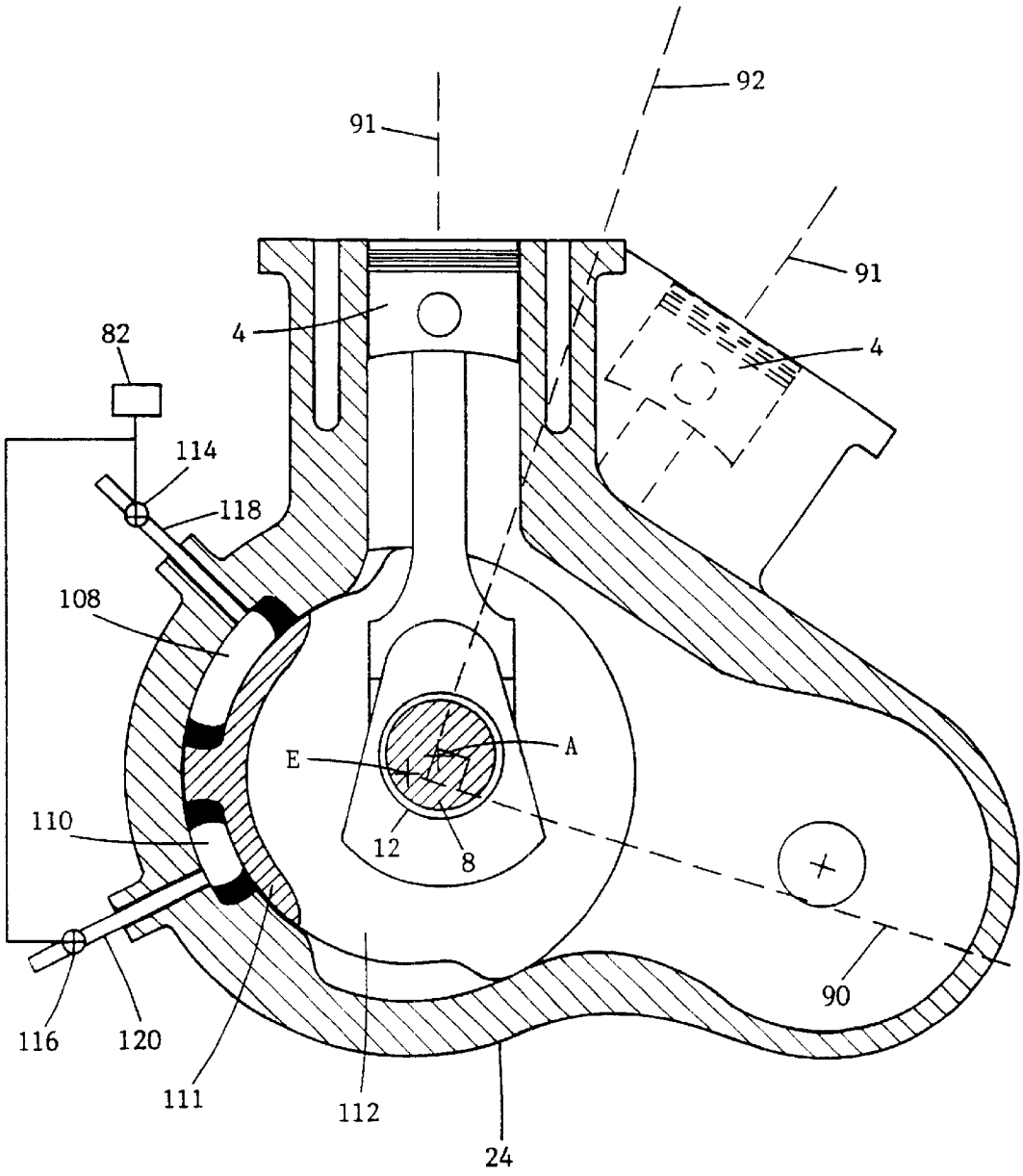
FIG. 7 is similar to FIG. 1 but shows a two cylinder engine having oil chamber 108, oil chamber 110, and crankshaft cradle 112.

Engine 2 has one or more cylinders 20. In multi-cylinder engines according to the present invention, the cylinders are preferably in-line or in a steep "V" orientation, as shown in FIG. 7, however other arrangements may be used. Referring now to the single cylinder shown in FIGS. 1 and 2, within engine 2 the geometric cylinder displacement D of the cylinder within engine 2 is equal to the product of the full stroke of piston 4 in cylinder 20 times the cross sectional area of cylinder bore 20. The engine displacement or cylinder displacement of engines according to the present invention having one or more cylinders is the sum of the geometric cylinder displacements of all of the working cylinders of the engine. Imaginary point X is located at the geometric center of the cross sectional area of cylinder bore 20, and immediately above (just out of reach of) piston 4 when piston 4 is fully extended away from crankshaft rotational axis A when engine 2 is at its highest compression ratio setting. Preferably, cylinder bore 20 is round, however cylinder bore 20 may have other cross sectional area shapes such as oval, square, or another shape. Those skilled in the art will appreciate that the top of piston 4 may be flat or have a non-flat surface. The cylinder within engine 2 has a combustion chamber volume, or end chamber volume, d having a minimum $d_{min}$ and a maximum $d_{max}$. Combustion chamber volume d is the volume between cylinder head 26 and piston 4 when piston 4 is fully extended away from crankshaft rotational axis A. Crankshaft rotational axis A has a first position located on an axis F that provides the smallest combustion chamber volume, $d_{min}$. Combustion chamber volume $d_{min}$ is the volume between cylinder head 26 and piston 4 when piston 4 is fully extended away from crankshaft rotational axis A and crankshaft rotational axis A is located on axis F (e.g., rotational axis A is at its closest position to imaginary point X). Crankshaft rotational axis A has a second position located on an axis G that provides the largest combustion chamber volume, $d_{max}$. Combustion chamber volume $d_{max}$ is the volume between cylinder head 26 and piston 4 when piston 4 is fully extended away from crankshaft rotational axis A and crankshaft rotational axis A is located on axis G (e.g., rotational axis A is at its farthest position from imaginary point X). The compression ratio C of the cylinder shown within engine 2 is equal to, $$C=(D+d)/d$$

The maximum compression ratio $C_{max}$ of the cylinder shown within engine 2 is equal to, $$C_{max}=(D+d_{max})/d_{min}$$

The minimum compression ratio $C_{min}$ of the cylinder shown within engine 2 is equal to, $$C_{min}=(D+d_{max})/d_{max}$$

Crankshaft cradle 36 is rotatably mounted in a bore 46 in housing 24. Crankshaft cradle 36 may have a first eccentric member, main bearing support or section 48 and a second eccentric member, main bearing support or section 50. Crankshaft cradle 36 has one or more eccentrics such as eccentrics 38 and 40. Eccentric 38 is formed in section 48 and eccentric 40 is formed in section 50. Section 48 includes webbing 52, and section 50 includes webbing 54. Webbing 52 and 54 rigidly connects eccentric members 48 and 50 to one another. In detail, eccentrics 38 and 40 are rigidly joined by webbing 52 and 54, and may be held in position by a fastener such as pin, clip, screw or bolt 56 and more generally eccentric member sections 48 and 50 are rigidly, and preferably removably, connected together with one or more fasteners.

Figure 4:
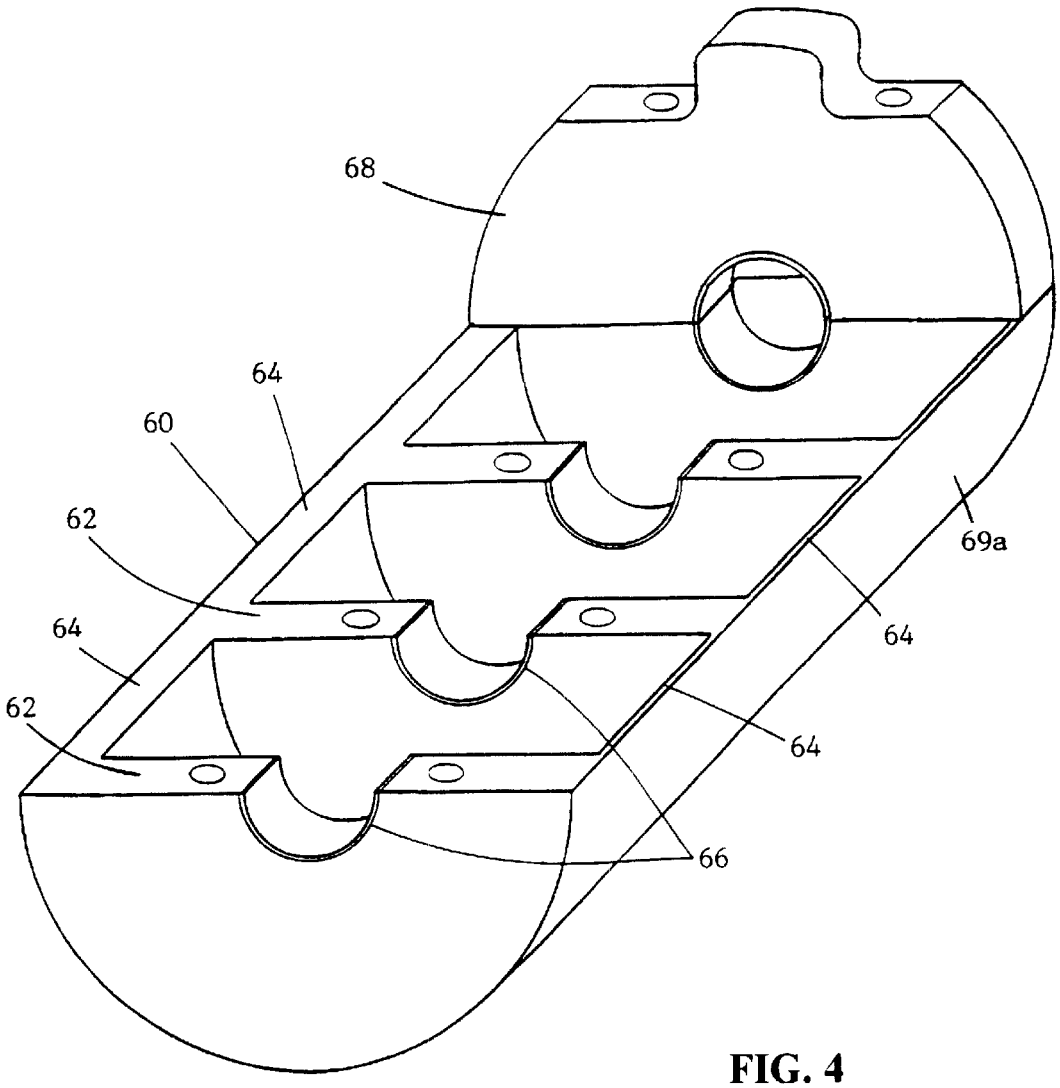
FIG. 4 shows a detailed view of the crankshaft cradle, shown in FIG. 3.
Figure 5:
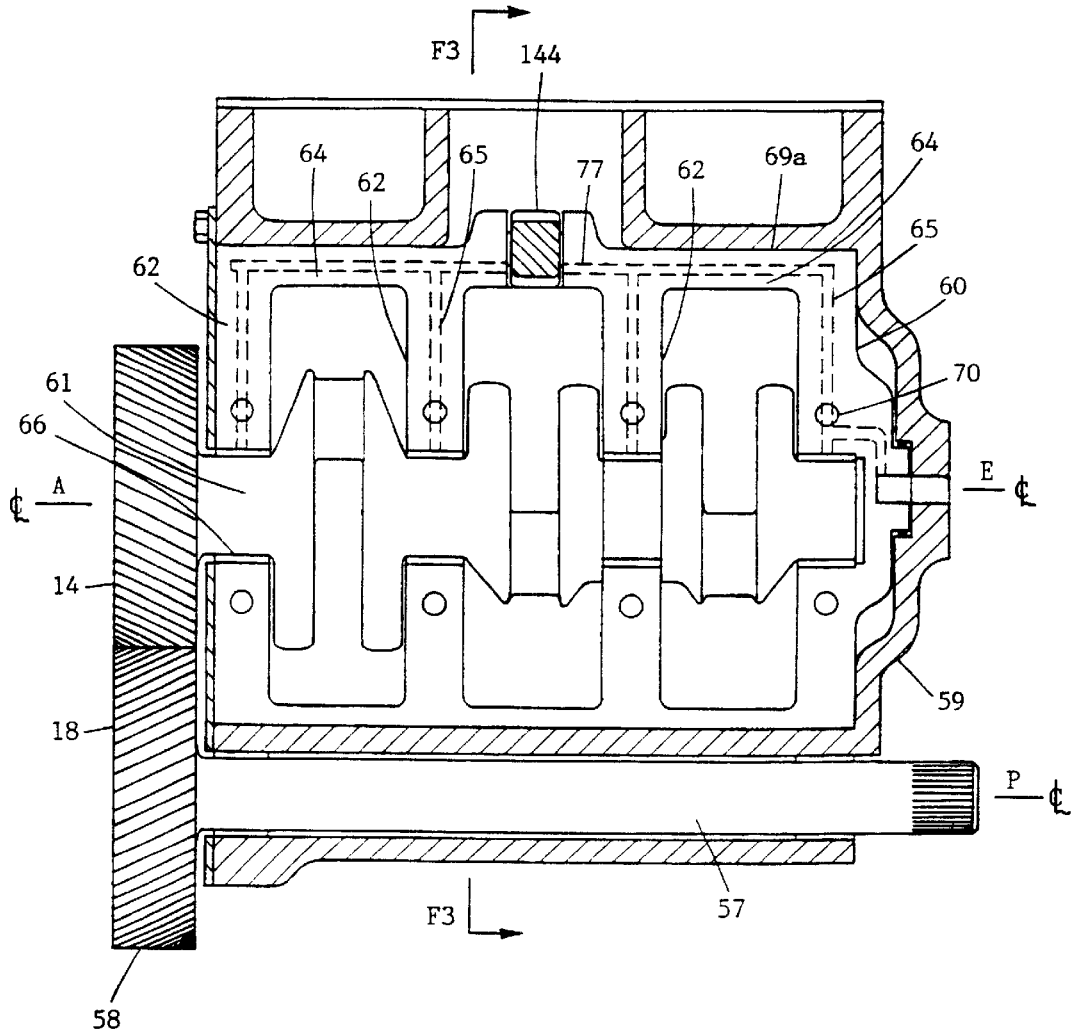
FIG. 5 shows a partial sectional view F5—F5 of FIG. 1.

Referring now to FIGS. 3, 4 and 5, in the preferred embodiment of the present invention, crankshaft cradle 60 has eccentric members or sections 62. Adjacent eccentric members or sections 62 are rigidly joined by webbing 64. Adjacent eccentric members or sections 62 joined by webbing may be an single cast part (as shown), or may be an assembly of parts, and more specifically crankshaft cradles comprising two or more eccentric members 62 and webbing 64 may be a one-piece cast part or an assembly of parts. FIGS. 4 and 5 show four eccentric members 62 and webbing 64 cast together as one rigid part and supporting four main bearings 66. Sections 68 may serve as crankshaft main bearing caps. Bearing cap bolts or fasteners 70 rigidly and preferably removably secure said bearing caps 68 to eccentric member or sections 62. Referring now to FIGS. 1 through 5, according to the present invention, adjacent eccentric members are rigidly joined by webbing effective for rigidly holding the eccentric members and the crankshaft main bearings in alignment on crankshaft centerline axis A.

Referring to FIGS. 1 and 2, main bearings 12 are mounted or formed in eccentrics 38 and 40 for supporting crankshaft 8. Bearings 12 may be journal bearings. roller, needle, tapered, spherical, or ball bearings, or any other functional bearing means for supporting crankshaft 8 in eccentric 38 and 40. Preferably bearings 12 are separable permitting assembly of crankshaft 8 in crankshaft cradle 36. Bearings 12 may be separable by sliding sections 48 and 50 apart along axis E. Referring now to FIGS. 3, 4 and 5, bearings 66 are separable by removing bolts 70 and separating eccentric member or section 62 and bearing cap or section 68.

Referring now to FIGS. 1 and 2, crankshaft cradle 36 and eccentrics 38 and 40 rotate about a pivot axis E. According to the present invention, one or more fluid chambers 72 are formed between housing 24 (and/or housing 24 plus one or more end surfaces 74 and 76) and crankshaft cradle 36. Those skilled in the art will appreciate that other surfaces may be used to contain fluid within chamber 72. The fluid in chamber 72 is oil or a similar hydraulic working fluid. The rotational position of crankshaft cradle 36 and eccentrics 38 and 40 on pivot axis E is adjusted by adjusting the volume of chamber 72. Preferably, the fluid in chamber 72 exerts a force directly on crankshaft cradle 36, causing crankshaft cradle 36 to rotate about pivot axis E, and causing the position of crankshaft rotational axis A to be adjusted. The volume of chamber 72 is adjusted by admitting or releasing fluid from chamber 72, and in more detail by pumping fluid into chamber 72 or releasing fluid from chamber 72. Chamber 72 is in fluid communication with one or more fluid passageways 78. One or more valves 80 control flow of fluid through passageway 78 (or other passageway in fluid communication with chamber 72), and thus control flow of fluid into and out of chamber 72. Valve 80 is controlled by a controller 82 or other control means. Crankshaft cradle 36 and eccentrics 38 and 40 may rotate up to 0 degrees from a first position to a second position. In the first position, crankshaft rotational axis A is located on axis F, and in the second position crankshaft rotational axis A is located on axis G. Referring now to the combustion chamber volume d shown within engine 2, releasing fluid from chamber 72 through valve 80 causes crankshaft cradle 36 to rotate (clockwise) about pivot axis E θ degrees (due to downward. force on eccentric sections 38 and 40, and on crankshaft cradle 36 from crankshaft 8 and/or due to other applied forces), causing crankshaft 8 to move (be lowered) from centerline F to centerline G, causing volume d to be increased from $d_{min}$ to $d_{max}$ and causing the compression ratio C of the cylinder shown within engine 2 to be reduced from $C_{max}$ to $C_{min}$.Fluid can be pumped back into the chamber 72 to rotate crankshaft cradle 36 counterclockwise, causing the compression ratio C to be increased. Those skilled in the art will appreciate that the crankshaft rotational axis A can be adjusted to any position between axis F and axis G, and compression ratio C can be adjusted to any value between $C_{max}$ and $C_{min}$. According to the present invention, the volume of chamber 72 is adjusted to adjust the rotational position of crankshaft cradle 36 and eccentrics 38 and 40. Adjusting the rotational position of crankshaft cradle 36 and eccentrics 38 and 40 adjusts the position of crankshaft rotational axis A (e.g., the rotational centerline position of crankshaft 8) relative to housing 24, and adjusts the compression ratio C of engine 2. Those skilled in the art will appreciate that engine 2 can have one or more cylinders, and that the compression ratio C, displacement D, and combustion chamber volume d can be the same or different for each of the cylinders according to the present invention.

Figure 6:
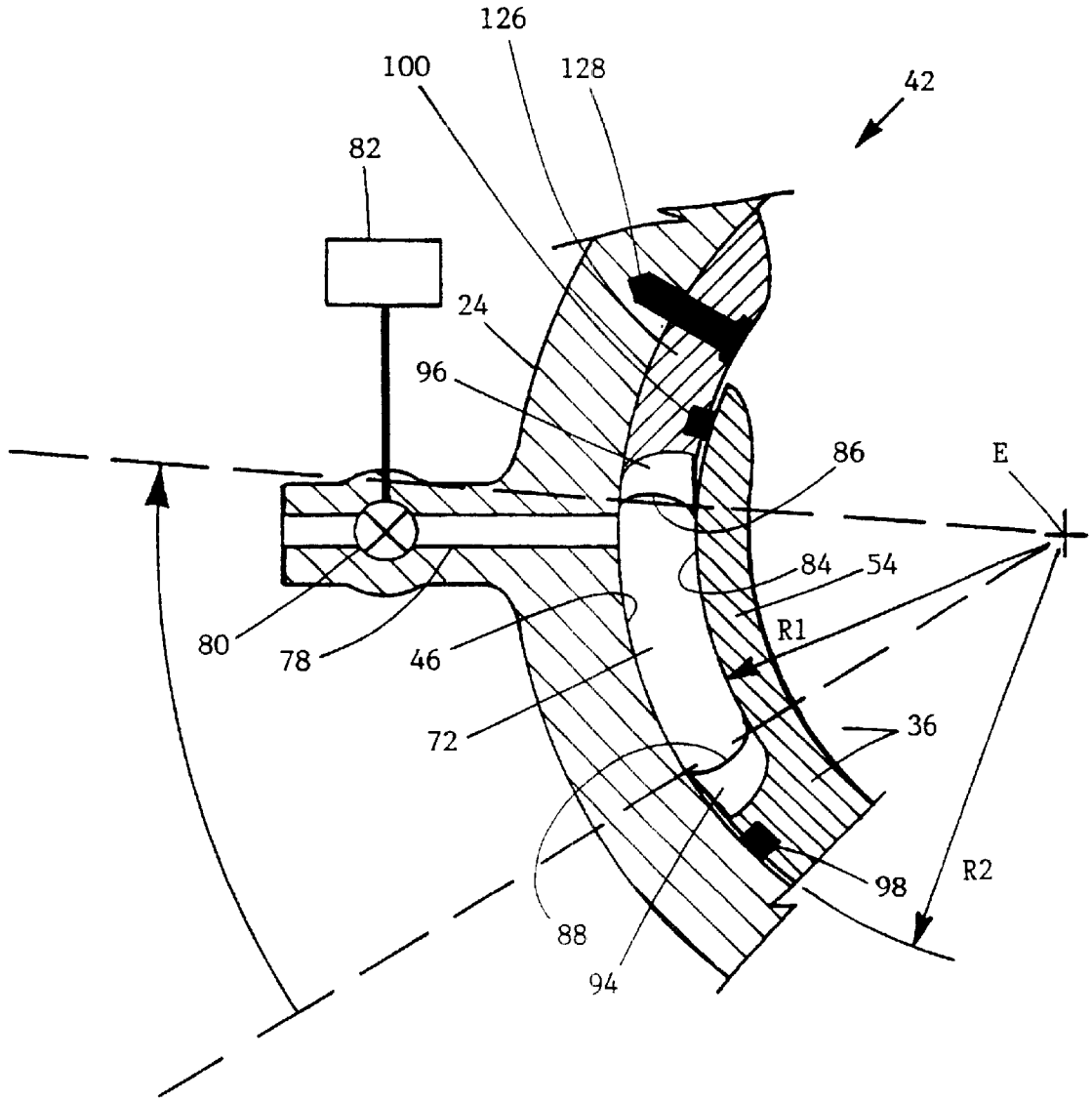
FIG. 6 is a detailed view of fluid chamber 72 shown in FIGS. 1 and 2.

FIG. 6 shows a detailed view of chamber 72, and more generally a rotary actuator 42 for rotating crankshaft cradle 36 and eccentrics 38 and 40 relative to housing 24. Referring now to FIGS. 1, 2 and 6, crankshaft cradle 36 has a surface 84 at radius R1 from pivot axis E that slidably engages a first chamber end surface 86 extending from bore 46. Surface 84 is preferably located on webbing 52 and 54. Those skilled in the art will appreciate that surface 84 may touch end surface 86 or be separated from end surface 86 by a small clearance (e.g., by a small working tolerance between parts). Chamber 72 has a second chamber end surface 88 extending from surface 84 that slidably engages bore surface 46. Those skilled in the art will appreciate that end surface 88 may touch bore 46, or be separated from bore 46 by a small clearance (e.g., by a small working tolerance between parts). Chamber 72 is formed by surface 84, bore surface 46, end surface 88, end surface 86, and a top surface 74 and a bottom surface 76. Those skilled in the art will appreciate that top surface 74 and/or bottom surface 76 may be a continuation of, or radiused from. surface 46, surface 84, surface 88, and/or surface 86.

One or more seals may be used to retain fluid in chamber 72, such as face seals 94 and 96, line seals 98 and 100, and end surface seal 102 and 104. Those skilled in the art will appreciate that other seal types and arrangements may be used to retain fluid in chamber 72. According to the present invention, hydraulic fluid in chamber 72 acts on crankshaft cradle 36. More generally, crankshaft 8 is mounted in eccentrics 38 and 40 in crankshaft cradle 36, and crankshaft cradle 36 is the rotary element of rotary actuator 42, e.g., crankshaft 8 is mounted in the rotary element of the rotary actuator. The present invention is compact in design and provides ridged support of crankshaft 8, which improves crankshaft durability and life, and reduces vibration and noise. The present invention is simple in design and inexpensive to manufacture, and has exceptional reliability and durability.

At times during operation of the present invention, the fluid in chamber 72 is at high pressure, such as during the power stroke of engine 2 when piston 4 is bearing down on connecting rod 6. During the intake stroke of engine 2, the downward motion of piston 4 and connecting rod 6 may cause crankshaft 8 to exert an upwards force on eccentrics 38 and 40, causing crankshaft cradle 36 to rotate counterclockwise, and the fluid pressure in chamber 72 to decrease. Crankshaft cradle 36 may be held in position by retaining means such as a pre-tensioning spring 106 (see FIG. 9), a second hydraulic fluid chamber (see FIGS. 7, 10, and 12), a friction brake, a sliding pin, or other means that fixes or substantially retain and/or hold firm the position of crankshaft cradle 36 relative to housing 24. Pre-tensioning spring 106 may be used to exert a clockwise torque on crankshaft cradle 36 (e.g., spring 106 moves crankshaft axis A in a direction generally away from piston 4, encouraging the compression ratio to be reduced), to minimize and/or prevent counterclockwise movement of crankshaft cradle 36 when a change of compression ratio is not being sought. Spring 106 minimizes and/or substantially prevents rotational vibration or bounce of crankshaft cradle 36 in bore 46.

FIG. 7 is similar to FIG. 1 except that FIG. 7 shows a first fluid chamber 108, a second fluid chamber 110, a crankshaft cradle 112, and webbing 111. Chamber 108 is similar to chamber 72 (shown in FIGS. 1 and 6) in that increasing the volume in chamber 108 (e.g., by pumping hydraulic fluid into chamber 108) rotates crankshaft cradle 112 counterclockwise, causing crankshaft 8 to be raised and the compression ratio C to be increased. Chamber 110 is filled with fluid to retain crankshaft cradle 112 in a fixed or near fixed position, and prevent crankshaft cradle 112 from substantively rotating or vibrating under the cyclic (and in some cases reversing) loads applied to crankshaft cradle 112 by crankshaft 8, and in more detail to retain crankshaft cradle 112 in a fixed or near fixed position except during periods when valves 114 and/or 116 are adjusted to adjust the position of crankshaft cradle 112 and main bearings 12 relative to housing 24. Chamber 110 may also be used to forcibly rotate crankshaft cradle 112 clockwise, causing crankshaft 8 to be lowered, and causing the compression ratio C to be lowered. Controller 82 and valves 114 and 116 are used to control feed of fluid into and out of chambers 108 and 110 through fluid passageways 118 and 120. Other valves and fluid passageways, and other valve and fluid passageway arrangements may be used to control the volume of fluid in chambers 108 and 110.

Referring now to FIGS. 1 and 2, power is transferred from crankshaft 8 to power take-off shaft 16 through a power output coupling 58 comprising gears 14 and 18. According to the present invention, the distance between the crankshaft rotational axis A and the power shaft rotational axis P changes as the crankshaft rotational axis A is moved and the compression ratio of the engine is changed. More specifically, the power output coupling has at least one external power take-off gear 14 on crankshaft 8 and power shaft 16 has an axis of rotation P and an external power input gear 18. External power take-off gear 14 is engaged with external power input gear 18, and crankshaft 8 has a first axial position having a first distance from power shaft axis P at a said first pivot position of cradle 36, and crankshaft 8 has a second axial position having a second distance from power shaft axis P at a second pivot position of cradle 36. and the second distance is greater than said first distance. Gears 14 and 18 are external gears (not internal or annular gears) and have involute, epicycloid or other suitable gear tooth shapes so that the durability of the gears is not substantively effected by minor changes in the centerline distance between the crankshaft 8 and the power shaft 16. Preferably gears 14 and 18 are helical gears having parallel axes of rotation, to provide a higher load carrying capacity, a higher operational speed capability, and reduced noise.

Referring now to FIGS. 1 and 7, each piston 4 in the engine has a translation axis 91. Engines according to the present invention have a mean translation axis or centerline axis 92, where the centerline axis 92 is defined as the translation axis 91 in single cylinder engines and the bisecting or average translation axis in multi-cylinder V or W engines.

In order to minimize change in the distance between the crankshaft gear 14 and the power shaft gear 18 during changes of compression ratio, in the preferred embodiment, axis P is positioned within plus or minus 45° of a first plane. Specifically, a first plane 90 passes through pivot axis E and is perpendicular to the centerline axis 92. A first crankshaft axis is located approximately on the first plane, said centerline axis and said crankshaft axis being on the same side of said pivot axis. A second plane **90*b* passes through the first crankshaft axis, said second plane and said first plane being separated by 45°, and a third plane 90*c* passing through said first crankshaft axis, said third plane and said first plane being separated by 45° and said second plane and said third plane being separated by 90°. Axis P is located between the second plane and the third plane, thereby minimizing the maximum backlash between the external power take-off gear and the external power input gear. Those skilled in the art will appreciate that axis P may be located to the right or left of crankshaft 8** according to the present invention. Alternatively, the first plane has its origin at and is perpendicular to, a second plane that passes through axis F and G. Axis P is positioned within plus or minus 45° of the first plane, where the plus or minus 45° is measured from the origin of the first plane. Those skilled in the art will also appreciate that placement of axis P within plus or minus 45° of the first plane provides a minimum gear backlash in engines both having rigidly connected and not rigidly connected main bearing supports.

An anti-backlash gear 112 may be used to prevent gear chatter and wear. Anti-backlash gear 112 is spring loaded to keep the larger load bearing gear 18 in contact with its mating crankshaft gear 14 at all or almost all times. Alternatively, an anti-backlash gear may be mounted on crankshaft 8. Power shaft 16 may have one or more balance weights 124. Those skilled in the art will appreciate that the balance weight 124 is optional. In the preferred embodiment, the power output of the engine is through the power shaft, since its centerline is fixed along axis P, and thus power shaft 16 can easily be coupled to a clutch, transmission or other rotating element (all not shown). Power output for boats, airplanes, and some other applications may be directly through crankshaft 8, as adjusting the centerline of crankshaft 8 may not significantly affect system performance.

Referring now to FIGS. 1, 2, and 6, preferably the engine is assembled by sliding crankshaft cradle 36 into bore 46 along axis E. Bore 46 in housing 24 can be machined at low cost and provides ridged support of crankshaft cradle 36. One or more parts 126 may be attached (or formed into the inside of bore 46) by a screw 128 or other attachment means such as a bolt, a slot, or adhesive. Those skilled in the art will appreciate that other parts may be attached or formed into the inside of bore 46. Attaching parts inside bore 46 (as opposed to machining forms extending inward from radius R2) enables bore 46 to be machined at low cost. An opening 130 (dashed lines) may be provided for access to bolts and for oil drainage.

A significant advantage of the present invention is that crankshaft cradle 36 and housing 24 rigidly hold crankshaft main bearings 12 in alignment (for single and multi-cylinder engines). Rigidly supporting the crankshaft main bearings 12 in alignment significantly improves crankshaft durability, and reduces noise and vibration. Those skilled in the art will appreciate that a crankshaft for a multi-cylinder/piston engine can be rigidly supported with the present invention, and for example with an eccentric that has more than two ridged crankshaft bearing supports.

In the single cylinder engine shown in FIGS. 1 and 2, crankshaft cradle sections 48 and 50 slide onto the ends of the crankshaft 8, and may also slide into bore 46. The crankshaft cradle sections 48 and 50 may be fastened together by a screw 56 or by other fastener means such as a bolt, pin, brazing, or adhesive. Preferably, end plates 132 and 134 are bolted to housing 24 to secure crankshaft cradle sections 48 and 50 in place. Endplates 132 and 134 may be used to retain crankshaft cradle sections 48 and 50 in position. Bolting endplates 132 and 134 to housing 24 may compressively set seals 102 and 104 in place. Those skilled in the art will appreciate that one or both endplates may be formed in housing 24 (for example, one or both end surfaces 76 and 74, may be machined out of housing 24), and/or other means may be used to retain crankshaft cradle sections 48 and 50 in position.

Figure 11:
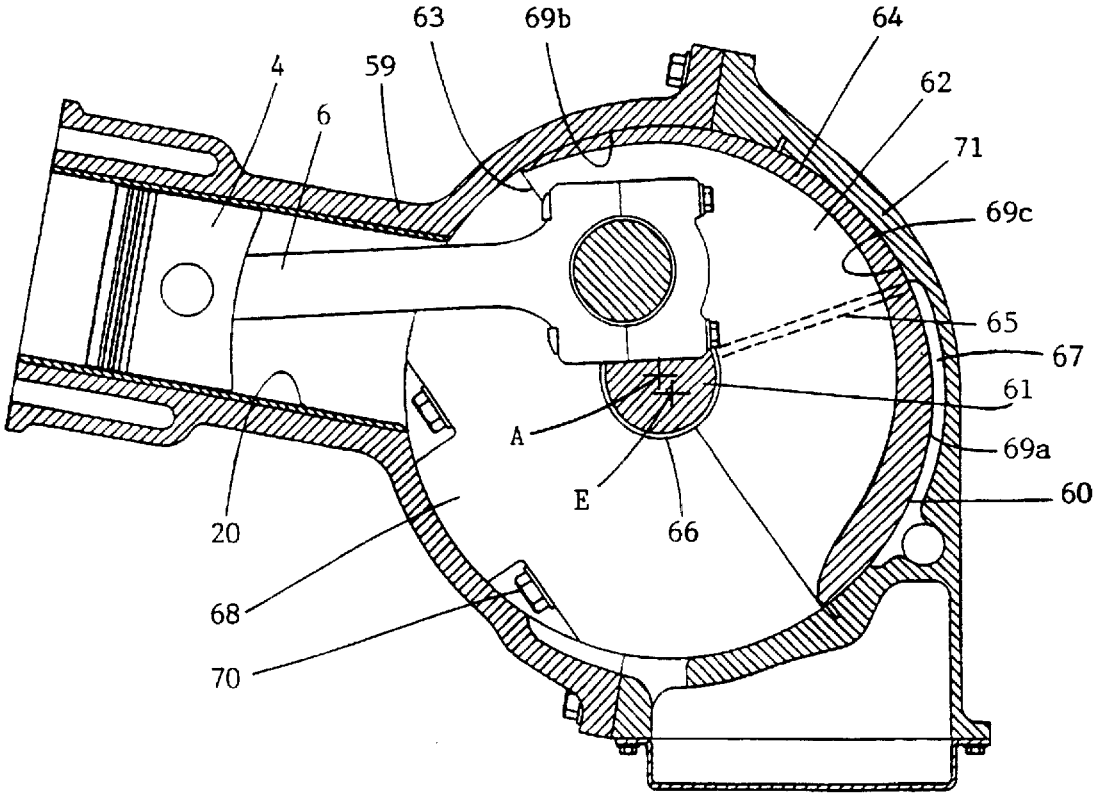
FIG. 11 is similar to FIG. 3 and shows another embodiment of the present invention.

FIG. 11 shows in sectional view part of a three cylinder variable compression ratio engine according to the present invention, having a piston 4, a connecting rod 6, a crankshaft 61 having a rotational axis A and crankshaft bearings 66, a cylinder 20, in a housing 59, an crankshaft cradle 60, and an eccentric main cap 71. Crankshaft cradle 60 comprises eccentric members or section 62 and webbing 64 rigidly connecting two or more of the eccentric members 62. Eccentric members 62 and bearing caps or sections 68 have a separation surface 63. Those skilled in the art will appreciate that separation surface 63 may be on an imaginary flat plane that bisects axis A, a curved surface that bisects axis A, or another imaginary surface that allows assembly of crankshaft 61 into crankshaft cradle 60. Sections 62 and 68 are joined by bolts or fastener 70 or other functional means. Crankshaft cradle 60 is rotatably supported in housing 59 by eccentric main cap 71. Removable main cap 71 enables crankshaft cradle 60 to be laid into the housing as an alternative to the slide-in assembly described above. Specifically, FIG. 1 shows a rigid engine construction having a housing 24 having an upper housing portion 24*a* and a lower structure 24*b*, where the upper housing portion 24*a* and the lower structure 24*b* is a one-piece metal casting, and eccentric members 48 and 50 slide into housing 24 on axis E. Bore 46 may be formed in lower structure 24*b*, or lower structure 24*b* may support a bearing element having a bore 46 for supporting the cradle (not shown). Referring now to FIG. 11, an oil feed line 65 in section 62 and an oil supply galley 67 provide oil to crankshaft bearings 66. Galley 67 is preferably about as wide as it is deep. Referring now to FIGS. 3 and 5, oil feed line 77 is in webbing 64 and oil feed line 65 is in eccentric member 62.

FIG. 4 shows a detailed view of cradle or crankshaft cradle 60. Crankshaft cradle 60 has eccentric members or sections 62 for rigidly supporting crankshaft bearings 66. Eccentric members or sections 62 are rigidly joined or connected to one another by cross webbing structure 64. Referring now to FIGS. 1 and 2, eccentric members or sections 48 and 50 are rigidly joined or connected to one another by cross webbing 52 and 54. According to the present invention, crankshaft cradle 36 includes cross webbing structure 52 and 54 effective for rigidly holding crankshaft main bearings 12 in alignment, and crankshaft cradle 60 includes cross webbing structure 64 effective for rigidly holding crankshaft main bearings 66 in alignment.

Referring now to FIGS. 3, 4 and 11, cross webbing structure 64 has an outer surface 69*a* that bears on a bore surface in housing 59 including an inner housing surface 69*b* and on an inner main cap surface 69*c*. Crankshaft cradle 60 having outer surface 69*a* is rotatably mounted inside said bore surface in housing 59 and/or eccentric main cap 71. Outer surface 69*a* may extend onto the outer surface of webbing structure 64, and outer surface 69*a* may form a continuous surface between adjacent eccentric members or sections 62 (shown). According to the present invention, crankshaft cradle 60 may be supported along all or a portion of bearing surface 69*a*.

Figure 8:
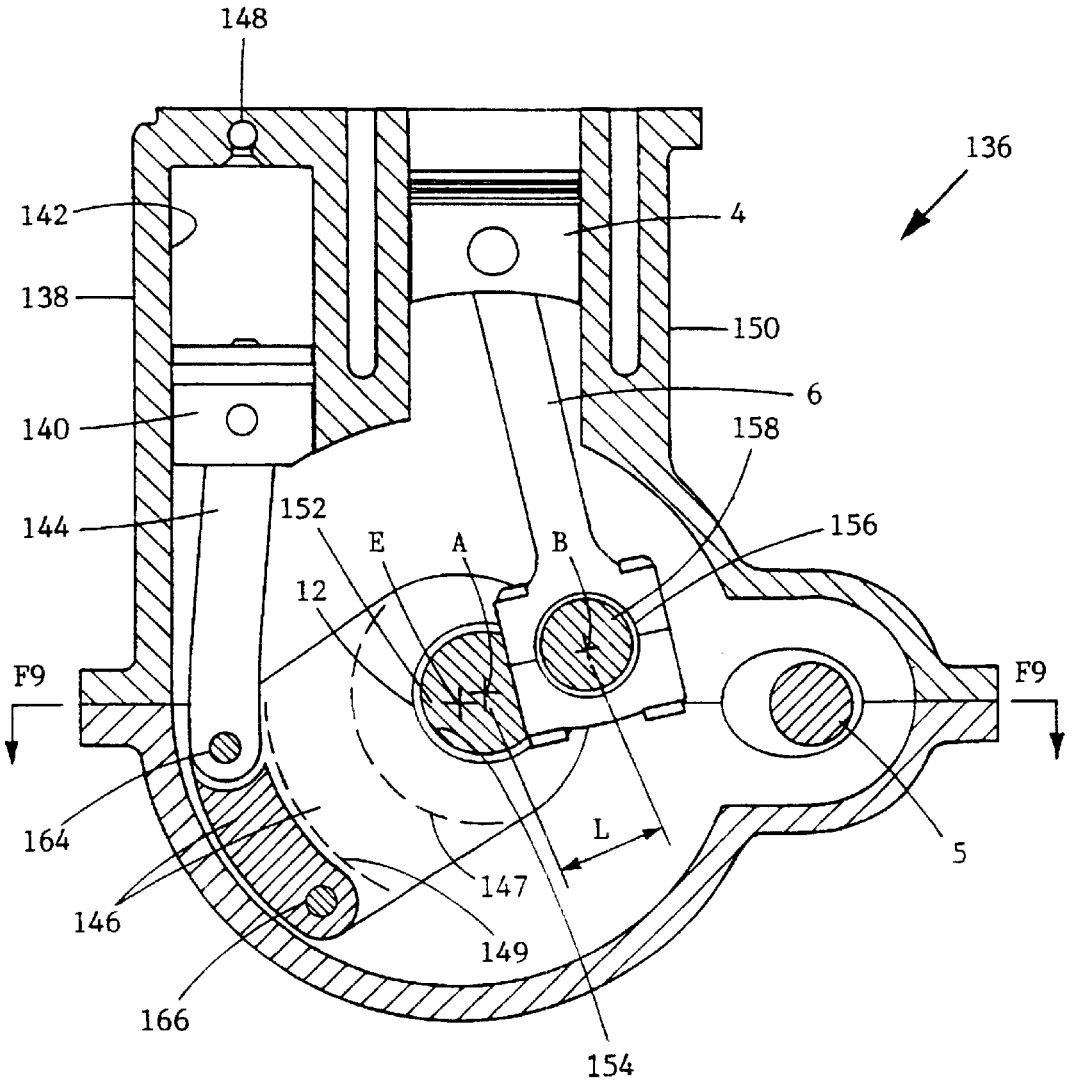
FIG. 8 shows a partial sectional view of an engine according to the present invention.

FIG. 8 shows a partial sectional view of an engine 136 according to the present invention. FIG. 8 is similar to FIG. 1 except that FIG. 8 shows a piston type hydraulic actuator 138 having a hydraulic piston 140 slidably housed in a hydraulic cylinder 142 for linear translation movement. Piston 140 is pivotaly connected to an actuator link or arm 144, and arm 144 is pivotaly connected to a crankshaft cradle 146. Piston 140 may be connected to cradle 146 by actuator link or arm 144 or by another type of coupling such as a rack and pinion gear set, an eccentric bushing between arm 144 and bolt or pin 164, or another functional arrangement. Fluid enters and exits cylinder 142 through one or more passageways 148, and flow of fluid into and out of cylinder 142 is controlled by one or more valves (not shown). According to the present invention, pressurized fluid entering cylinder 142 through passageway 148 forces piston 140 and arm 144 in a generally downward direction (with respect to the orientation of engine 136 shown in FIG. 8) causing crankshaft cradle 146 to rotate counterclockwise about axis E causing crankshaft centerline A to rise and the compression ratio of engine 136 to be increased.

Figure 9:
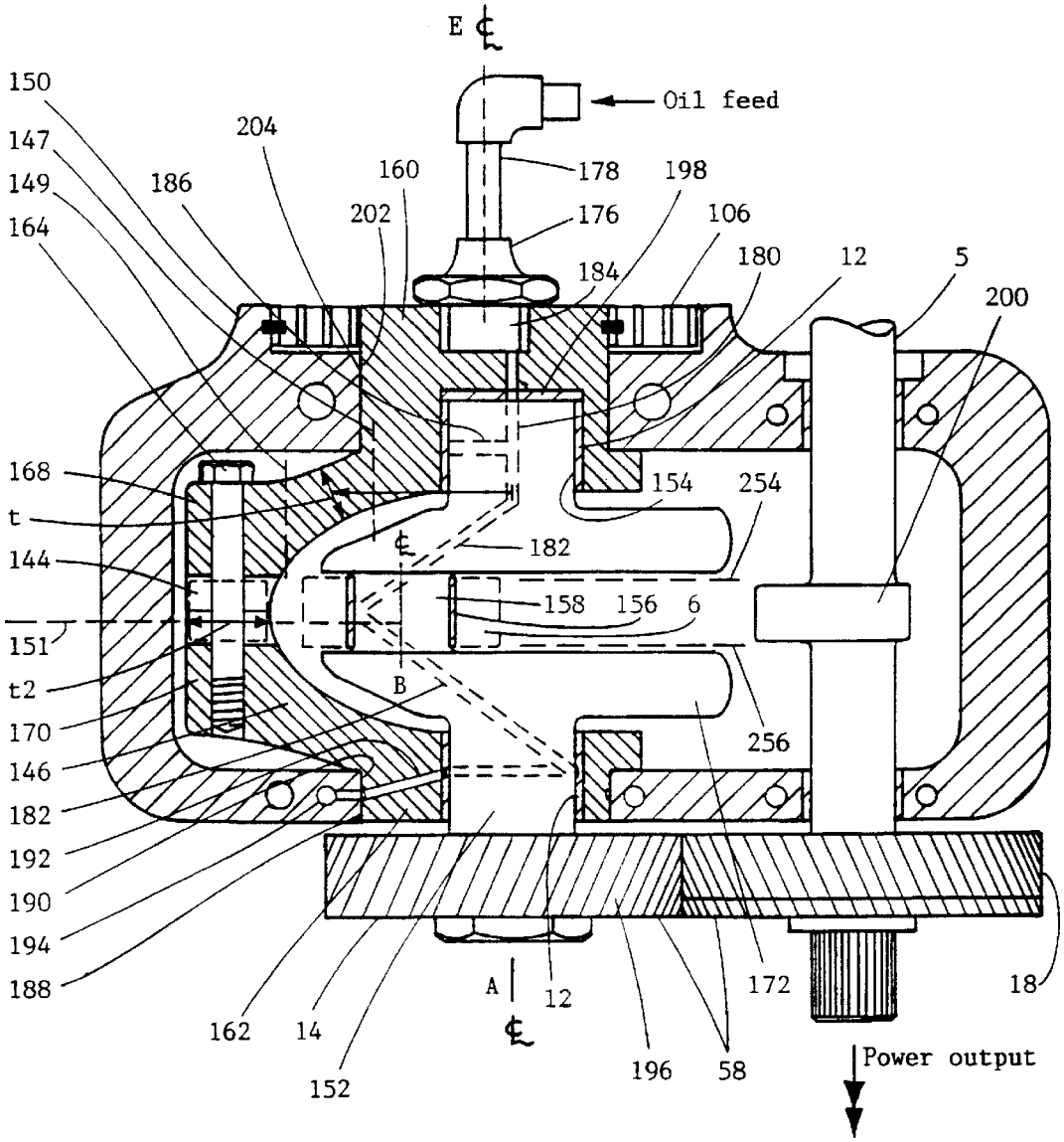
FIG. 9 shows a partial sectional view of an engine according to the present invention.

An actuator first adjusts the rotational position of the crankshaft cradle about its pivot axis E, and then locks the rotational position of the cradle in place. Referring now to FIGS. 2, 5 and 9, according to the present invention, the actuator is preferably connected to the middle of the crankshaft cradle, e.g., between the front and the back main bearings (e.g., between the two main bearings that are spaced farthest apart) and more generally between the front and back eccentric members or main bearing supports (e.g., between the two eccentric members that are spaced farthest apart), providing a centrally applied force on the cradle, whereby twisting of the crankshaft cradle and misalignment of the main bearings is minimized. FIG. 9 shows placement of actuator arm 144 between the main bearings 12 and more generally between eccentric members 160 and 162, providing balanced loading of actuator force on crankshaft cradle 146. FIG. 5 shows placement of actuator arm 144 between the main bearings 66 and more generally between the two eccentric members 62 spaced farthest apart, providing balanced loading of actuator force on crankshaft cradle 61. FIG. 2 shows the fluid chamber of an actuator 42 applying even pressure on crankshaft cradle 36 along its length, and more generally between eccentric members 48 and 50. Accordingly, the eccentric members are rigidly maintained in alignment providing a long main bearing life.

FIG. 9 shows a partial sectional view of engine 136 taken along cut lines F9—F9 shown in FIG. 8. Referring now to FIGS. 8 and 9, engine 136 has a housing 150, a piston 4, a connecting rod 6, a crankshaft 152 mounted in bearings 12 having an inner diameter 154 for carrying crankshaft 152, and bearings 12 are housed in crankshaft cradle 146. Hydraulic cylinder 142 is formed in or rigidly aligned with housing 150. Connecting rod 6 has a big-end bearing 156, and is rotatably mounted on crankshaft 152 on crank 158 having a bearing axis B. Preferably crankshaft cradle 146 has a first eccentric section 160 and a second eccentric section 162 that slide onto opposite ends of crankshaft 152, and are rigidly held together by one or more fasteners such as bolts 164 and 166, or by other means such as a pin or screw. Section 160 includes a first structure 168 for retaining bolts 164 and 166, and section 162 includes a second structure 170 for retaining bolts 164 and 166. Bolt 164 may serve as a connecting pin, linking or pivotaly connecting arm 144 and crankshaft cradle 146. Preferably, bolt 164 serves as a connecting pin and is generally centered between section 160 and section 162, so that force from arm 144 is substantially applied equally to sections 160 and 162 in order to minimize misalignment of bearings 12. In detail, the connecting pin portion of bolt 164 is located in the axial direction along axis E between sections 160 and 162, and is located in the radial direction outside the swept path of crankshaft 152, connecting rod 6 (including the connecting rod big end bearing cap), and counterweights (172 shown in FIG. 9). Crankshaft 152 may have counterweights 172. In FIG. 8, counterweights 172 are not shown (i.e. cut away) to show bearing 156 at the big end of rod 6, and the crankshaft main bearings 12. As shown in FIG. 9, a pre-tensioning means in the form of a spring 106 applies a torque on crankshaft cradle 146. Spring 106 may be attached directly to crankshaft cradle 146 and housing 150. Preferably, spring 106 is coiled around axis E and attached to an end of crankshaft cradle 146. Referring now to FIGS. 8 and 9, spring 106 exerts a clockwise torque on crankshaft cradle 146, and encourages or causes the compression ratio of engine 136 to be decreased, and more specifically spring 106 exerts a torque on crankshaft cradle 146 causing (or encouraging) crankshaft cradle 146 to rotate causing crankshaft 152 to move in a direction away from piston 4 (e.g., causing or encouraging the compression ratio of engine 136 to be reduced). Hydraulic pressure in cylinder 142 acts against (e.g., resists) the torque on crankshaft cradle 146 from spring 106, and encourages or causes the compression ratio of engine 136 to be increased.

Oil is fed to bearings 12 and 156 through an oil supply fitting 176 preferably located on axis E and having an oil feed passageway 178, that is in fluid communication with oil feed lines (e.g., crankshaft passageways) 180 and 182. Preferably oil feed line 180 is located or centered on axis A, supply fitting 176 is located or centered on axis E, and supply fitting 176 is attached directly to section 160. An off-set passageway or eccentric transition space 184 connects feed line 180 and oil feed passageway 178 in fitting 176. Supply fitting 176 may include a rotary fitting or joint so that oil feed passageway 178 may remain stationary when section 160 and crankshaft cradle 146 rotate. During operation of the present invention, oil enters passageway 178 and flows into off-set passageway 184. The oil then flows to bearings 12 and 156 through passageways 180, branch passageway 186. and 182. Those skilled in the art will appreciate that other fluid passageway arrangements may be used according to the present invention to deliver oil to bearings 12 and 156. Surfaces 188 and 190 may be lubricated by feed line 192 and/or 194.

Gear 14 may have a helical or bevel tooth pattern 196 that pushes crankshaft cradle 146 in the direction of fitting 176. Crankshaft cradle 146 may have or bear on a thrust bearing 198 that resists axial thrust exerted by gear 14 or other axial thrust forces from other sources. Those skilled in the art will appreciate that other types of thrust bearings may be used according to the present invention.

Gear teeth 196 bearing down on power shaft gear 18 result in a reactionary upward force on gear 14 and crankshaft 152. The present invention includes a ridged crankshaft cradle 146 and a stiff housing 150 to prevent crankshaft cradle 146 from twisting under these and other forces and loads.

The crankshaft cradle K63 may be fabricated in cast iron, steel, aluminum, magnesium, titanium, or another material or combination of materials to provide ridged support of the crankshaft main bearings. Axis B and axis A are separated by length L. The stroke of the crank throw is 2L. The stroke of engine 136 is approximately 2L, and varies slightly because the cylinder axis does not intersect the crankshaft axis for all compression ratio settings. In general, the stroke of engine 136 is assumed to be 2L, with minor variances in stroke length ignored.

Figure 12:
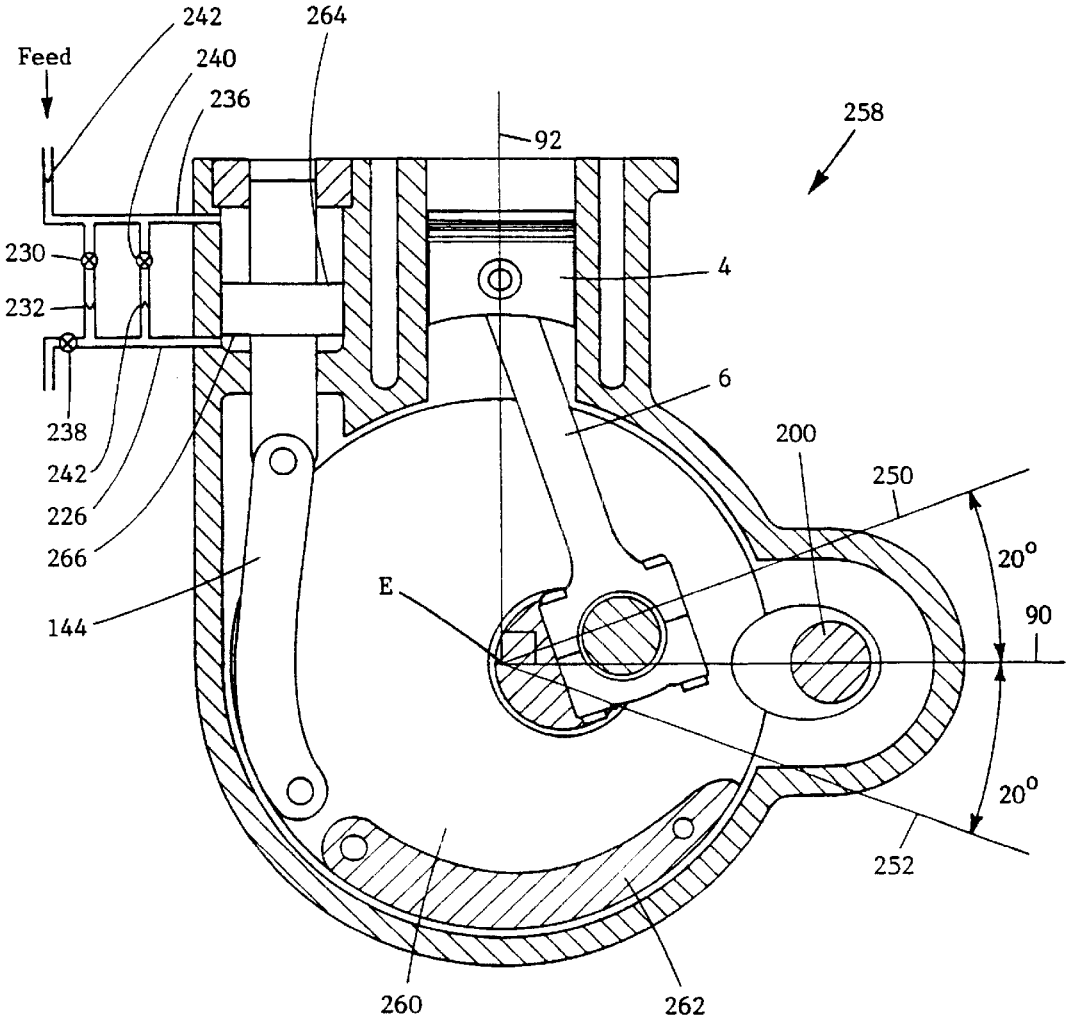
FIG. 12 shows a partial section of an engine according to the present invention having a close spacing between the crankshaft and the power shaft.

Referring now to FIGS. 7 and 12, during the operation of the engine, the movement of the connecting rod defines a connecting rod swept path. The webbing and eccentric members are located entirely outside the connecting rod swept path to prevent mechanical interference. According to the present invention, the engine may have a clearance zone to minimize crankshaft cradle mass and/or to provide clearance around a balance shaft 200 and/or the power shaft 5. In detail, according to the present invention, each piston has a translation axis, and the engine has a mean translation axis or centerline axis 92, where the centerline axis is defined as the translation axis in single cylinder engines, and the bisecting or average translation axis in multi-cylinder V or W engines. Engine 258 has a cradle 260, webbing 262, a first plane 90 originating at pivot axis E and passing through centerline axis 92, the first plane and the centerline axis being perpendicular. The engine has a second plane 250 originating at pivot axis E, the second plane being separated from the first plane 90 by 20 degrees, and the engine has a third plane 252 originating at pivot axis E, the third plane and the first plane being separated by 20 degrees, and said second plane 250 and said third plane 252 being separated by 40 degrees. The connecting rod swept path is bound by a fourth plane 254 and a fifth plane 256 (see FIG. 9), said fourth and said fifth planes being perpendicular to the rotational axis of the crankshaft. Engine 258 has a clearance zone bound by the second plane 250 and the third plane 252 and by the fourth plane 254 and the fifth plane 256, and the webbing 262 is located exclusively outside of said clearance zone at all compression ratio settings, providing a mechanical clearance between the crankshaft cradle and balance shaft 200, power shaft 5, and/or other engine components.

Referring now to FIG. 9, to provide ridged support of crankshaft bearings 12, crankshaft cradle 146 has a maximum thickness t between a first circle or cylinder 147 and a second circle or cylinder 149. The first circle 147 has a center on the rotational axis of the crankshaft A and has a diameter of 1.2 times the stroke of the crank throw, and the second circle 149 has a center on the rotational axis of the crankshaft A and has a diameter of 2.0 times the stroke of the crank throw. Preferably, the maximum thickness between the first and second circle is at least 0.10 times the thickness of the stroke of the crank throw providing a rigid cradle. Preferably, the maximum thickness along the first circle is also at least 0.10 times the length of the stroke of the crank throw. According to the present invention, the ratio of the thickest section t of crankshaft cradle 146, between circles 147 and 149, divided by length L is greater than 0.10, (e.g., t/L>0.10) providing ridged support of main bearings 12.

Similarly, the crankshaft cradle has a second maximum thickness t2 on a plane 151 perpendicular to the rotational axis A of the crankshaft and passing through the crank throw 158. The second maximum thickness t2 is at least 0.10 times the length of said stroke providing a rigid cradle (e.g., t2/L>0.10)

As stated before, the crankshaft cradle may be a one-piece cast part, or an assembly of parts. Preferably, the webbing has a first portion, and the first portion has a thickness at a radial distance from the rotational axis of the crankshaft greater than the stroke, wherein a first eccentric member and the first portion is a one-piece metal casting, providing a rigid structure between the eccentric member and the webbing used to join adjacent eccentric members.

To provide low mechanical forces on the cradle, and a high vibrational natural frequency of the cradle (higher than the maximum operational speed of the engine), preferably the distance between the pivot axis and the crankshaft axis is at a minimum. Specifically, preferably the pivot axis passes through the swept path of the connecting rod.

In any event, crankshaft cradle 146 provides ridged support of bearings 12, and more specifically crankshaft cradle 146 holds bearings 12 in alignment within a tight tolerance, where the tight tolerance is small enough to prevent failure of bearings 12 or failure of crankshaft 152. In engines according to the present invention having two or more main bearing supports, and preferably engines with journal bearings according to the present invention, the tight tolerance is preferably a radial deflection of less than 0.008 inches (and preferably less than 0.004 inches) of the centerline of any one bearing 12 from the centerline of crankshaft cradle 146, and more specifically, measured from a zero deflection baseline where crankshaft bearings 12 are on a first straight axis of rotation and the crankshaft is on a second straight axis of rotation that is concentric with the first axis of rotation. Those skilled in the art will appreciate that the present invention provides a tight tolerance for crankshaft cradles that support crankshafts for one or more cylinder engines. In vehicles (such as in light duty passenger cars and light trucks as defined by the U.S. Environmental Protection Agency) applications of the present invention, crankshaft cradle 146 has a rigidity great enough to prevent failure of bearings 12 within a minimum of 100,000 miles of vehicle use. Light duty passenger car and truck engines are operated at part load most of the time. According to the present invention, bearing alignment is measured at a first engine setting having a crankshaft rotational speed between 1200 rotations per minute (rpm) and 6000 rpm, and at an engine mean effective pressure (mep) of less than 500 kilopascals ( 500 kPa). Mean effective pressure is defined on page 50 of Internal Combustion Engine Fundamentals, John, B. Heywood, McGraw-Hill Book Company, 1988, as follows, $$\text{mep(kPa)}=P(\text{kW})n_R\times10^3/V_d(\text{dm}^3)N(\text{rev}/s)$$

$n_R$ is equal to two (2) for four-stroke engines and one (1) for two-stroke engines. $V_d$ is swept engine displacement. N is engine rotational speed in revolutions per second, and P is power in kilowatts. More specifically, the first bearing has a first centerline axis and the second bearing has a second centerline axis, and the crankshaft cradle has sufficient rigidity to maintain the first and the second centerline axes within 0.008 inches of one another during operation of the engine at the first engine setting.

Engines having no more than two main bearing supports require less precise alignment of the main bearings, because a small amount of bearing misalignment does not apply a bending moment along the length of the crankshaft (i.e., a straight crankshaft axis can, in some cases, lie between two miss aligned bearing supports, but not between three miss aligned bearing supports). According to the present invention, for engines having no more than two crankshaft main bearing supports, the crankshaft cradle has sufficient rigidity to maintain said first and second centerline axes within 0.040 inches of one another during operation of the engine at said first engine setting. The engine is considered to have two crankshaft bearing supports if the two bearing supports support more than 85 percent of the crankshaft's radial load. Similarly, the crankshaft cradle has sufficient rigidity to limit rotation of the first bearing support or eccentric member relative to the second bearing support or eccentric member about the pivot axis of the cradle to one rotational degree (1°) about pivot axis E at said first engine setting. Crankshaft cradles having roller bearings, such as ball bearings, also require less precise alignment of the eccentric main bearing supports.

Referring now to FIGS. 8 and 9, crankshaft cradle 146 has a low rotational inertia, enabling actuator 138 to rapidly rotate crankshaft cradle 146 about axis E and to rapidly adjust the position of crankshaft centerline axis A. Eccentric section 160 has an outer or bearing diameter 202 that is rotatably housed in a bore 204 in housing 150, and eccentric section 162 has an outer or bearing diameter 190 that is rotatably housed in a bore 188 in housing 150. According to an embodiment of the present invention, to provide a low rotational inertia and a fast response, the ratio of inner diameter 154 to outer diameter 202 is greater than 0.40, and preferably greater than 0.30. Inner bearing diameter 154 refers to the effective diameter and more specifically the diameter of the hydraulic film separating the crank throw from the journal bearing element 12. For crankshaft cradles having roller bearings supporting the radial loads of the crankshaft, such as ball, cylindrical (including needle), tapered, and spherical roller bearings, the effective diameter is the circular path of the individual axes of rotation of the rolling elements. In the case of tapered, spherical, multiple row bearings, and other roller bearings having a range of circular path diameters, the circular path is measured from the largest circular path of the individual axes of rotation of the rolling elements. (Dampers, such as dampers 210 and 212, may be used to dampen deceleration of crankshaft cradle 214, shown in FIG. 10.)

Figure 10:
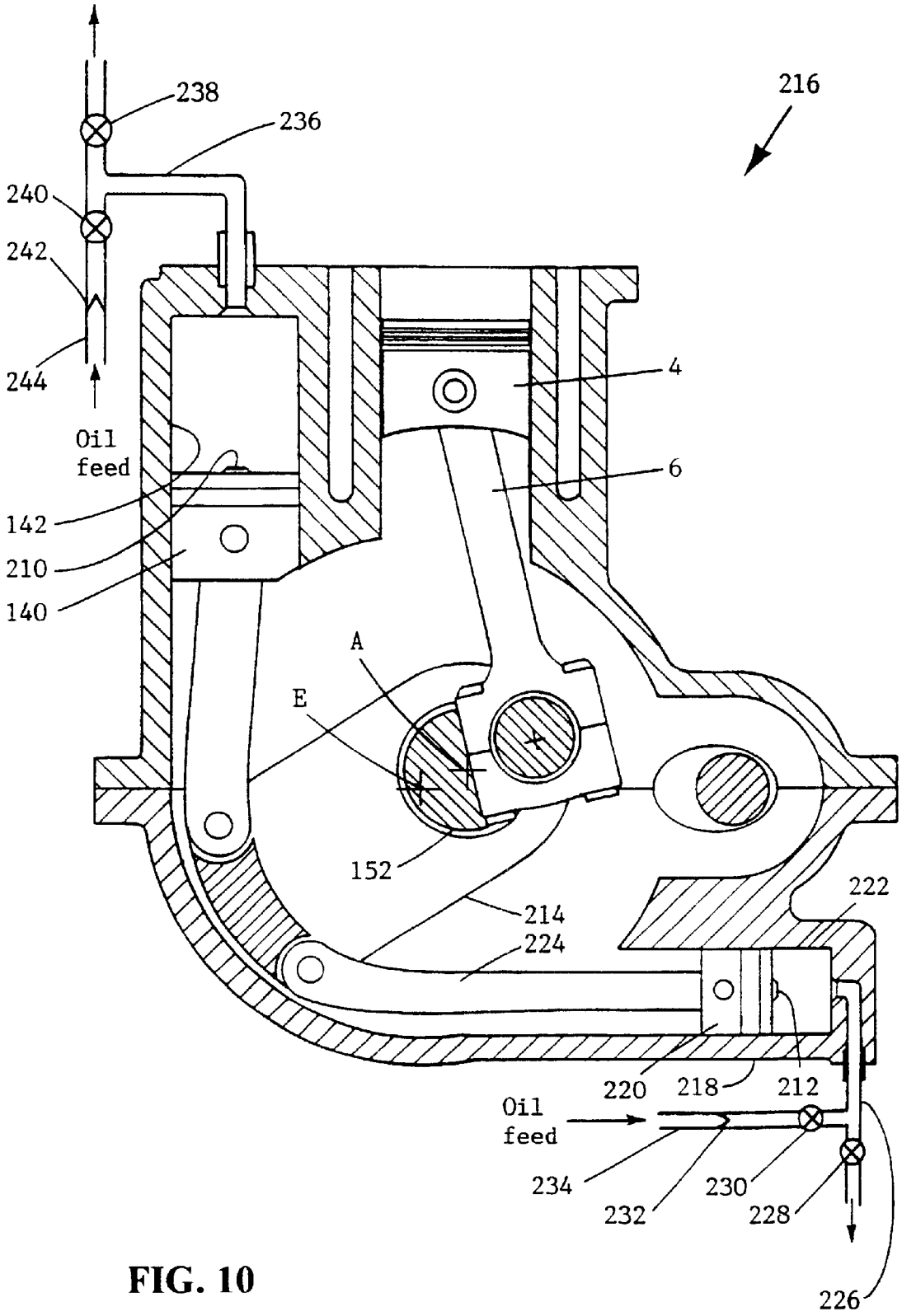
FIG. 10 shows a partial sectional view of an engine according to the present invention having a first actuator having a connecting arm and a second actuator having a connecting arm, for adjusting and retaining the position of the crankshaft cradle.

FIG. 10 shows a partial sectional view of an engine 216 according to the present invention. FIG. 10 is similar to FIG. 8 except that FIG. 10 shows a second hydraulic actuator 218 having a piston 220 slidably housed in cylinder 222. Piston 220 is pivotally connected to an arm 224, and arm 224 is pivotaly connected to a crankshaft cradle 214. Cylinder 222 has a fluid line 226, in fluid communication with a first valve 228 and a second valve 230. Second valve 230 may include a first check valve 232. Check valve 232 is in fluid communication with a pressurized oil feed line 234 which receives oil under pressure from the oil pump of the engine. Cylinder 142 has a fluid line 236, in fluid communication with a third valve 238 and a fourth valve 240. Fourth valve 240 may include a second check valve 242. Check valve 242 is in fluid communication with a pressurized oil feed line 244 which receives oil under pressure from the oil pump of the engine. Oil passing through valves 228 and 238 returns to the engine sump for eventual recirculation by the pump of the oil pump of the engine.

According to the present invention, crankshaft cradle 214 is rotated counterclockwise and crankshaft centerline axis A is moved towards piston 4 by opening first valve 228, opening fourth valve 240, closing second valve 230, and closing third valve 238. The position of crankshaft cradle 214 and crankshaft centerline axis A is retained in a fixed or near fixed position by closing first valve 228, leaving closed second valve 230 (optional), leaving closed valve third valve 238, and leaving open valve 240. Pressurized oil flows into cylinder 142 through feed line 244, check valve 242, fourth valve 240, and fluid line 236, causing crankshaft cradle 214 to rotate counterclockwise and piston 220 to compress oil retained in cylinder 222, where the position of crankshaft cradle 214 becomes fixed or nearly fixed when the pressurized oil entering cylinder 142 through feed line 236 can no longer rotate crankshaft cradle 214 counterclockwise due to the pressure of the oil in cylinder 222, and check valve 242 substantially prevents crankshaft cradle 214 from rotating clockwise. According to the present invention crankshaft cradle 214 is rotated clockwise, and crankshaft centerline axis A is moved away from piston 4 by closing first valve 228, closing fourth valve 240, opening second valve 230, and opening third valve 238. The position of crankshaft cradle 214 and crankshaft centerline axis A is retained in a fixed or near fixed position as described above, or by leaving closed first valve 228, leaving closed fourth valve 240, and closing third valve 238. Those skilled in the art will appreciate that the valve opening and closing sequences used to adjust and fix the position of crankshaft cradle 214 in engine 216, may be used to adjust the position of crankshaft cradle 112 shown in FIG. 7. Other valve opening and closing sequences may be used to adjust and fix the position of crankshaft cradle 214 in engine 216, and other types of valves may be used to control flow of fluid into and out of cylinders 142 and 222 according to the present invention. The position of crankshaft cradle 214 and crankshaft centerline axis A may also be retained in a fixed or near fixed position by closing first valve 228 opening second valve 230, closing valve third valve 238, and opening fourth valve 240.

Referring now to FIG. 10 (the embodiment shown in FIG. 7 may be operated in a similar manner), according to the present invention feed lines 244 and 234 are pressurized. Preferably standard oil pressure from engine 216 (e.g., below 100 psi.) may be used to rotate crankshaft cradle 214 and adjust the position of crankshaft centerline axis A. According to the present invention, the reversing loads on crankshaft cradle 214 from the reciprocating motion of piston 4 and connecting arm 6 may be used to rotate crankshaft cradle 214 counterclockwise about axis E and move crankshaft centerline axis A in a direction generally towards piston 4, and in some embodiments of the present invention making possible operation of the present invention with small diameter hydraulic pistons 140 and 220, and standard or near standard oil pressure. According to the present invention, the piston and connecting rod exert forces that change in magnitude on the crankshaft cradle during the induction and power strokes of the engine, and the check valve admits and retains fluid in the actuator during the induction stroke of the piston, causing the compression ratio to ratchet up. Specifically, crankshaft cradle 214 is rotated counterclockwise about axis E and crankshaft centerline axis A is moved in a direction generally towards piston 4 by closing valve 230, opening valve 228, closing valve 238, and opening valve 240. During the intake or induction stroke of engine 216, the downward motion of piston 4 and connecting rod 6 causes crankshaft 152 to exert an upwards force on crankshaft cradle 214, causing crankshaft cradle 214 to rotate counterclockwise, and fluid to flow out of cylinder 222 through valve 228, and fluid to flow into cylinder 142 through valve 240. Check valve 242 prevents fluid from leaving cylinder 142 during the power stroke of piston 4 when the force on crankshaft cradle 214 and crankshaft 152 from piston 4 and connecting rod 6 reverses and encourages crankshaft cradle 214 to rotate in a clockwise direction about axis E. Accordingly, the position of crankshaft centerline axis A ratchets up in steps, moving in a direction generally towards piston 4. When a desired position of crankshaft centerline axis A is reached, crankshaft cradle 214 may be retained in position by closing valve 228 (and optionally opening valve 230). The embodiments of the present invention just described work best with engines where the forces on crankshaft 152 reverse direction, such as in single cylinder engines and some multi cylinder engines, however, the forces on crankshaft 152 do not have to reverse for the rotational position of the crankshaft cradle to be adjusted according to the present invention, as the oil pressure in feed line 244 will encourage crankshaft cradle 214 to rotate in a counterclockwise direction when the pressure in cylinder 142 falls below the pressure in feed line 244. Preferably, pressure in line 244 is greater than in cylinder 142 when crankshaft cradle 214 is rotating counterclockwise, to support rotation of crankshaft cradle 214 and to prevent cavitation of oil in cylinder 142. Moving crankshaft centerline axis A in a direction generally away from piston 4 may be accomplished by closing valve 240, opening valve 238, closing valve 228, and opening valve 230.

Referring now to FIG. 12. preferably the first hydraulic piston 264 has the same area as the second piston 266, and fluid from the first hydraulic cylinder is directed directly into the second hydraulic cylinder, thereby preventing cavitation.

What is claimed is:

1. A variable compression ratio mechanism for an engine having at least one cylinder, a piston mounted for reciprocating movement in the cylinder, a crankshaft defining an axis about which the crankshaft rotates, and a connecting rod connecting the piston to the crankshaft, comprising;

a rigid crankshaft cradle supporting the crankshaft for rotation of the crankshaft about the rotational axis of the crankshaft, the cradle being mounted in the engine for pivoting relative to the engine about a pivot axis, the pivot axis being substantially parallel to and spaced from the rotational axis of the crankshaft, an actuator for varying the position of the cradle about the pivot axis for varying the position of the rotational axis of the crankshaft, said cradle comprising a primary member and a plurality of bearing caps and bearing cap bolts, said primary member comprising eccentric main bearing supports, said eccentric main bearing supports being rigidly connected by webbing, each bearing cap being removably fastened to each of said eccentric main bearing supports by said bolts, and a plurality of crankshaft main bearings, said crankshaft main bearings being mounted between said eccentric main bearing supports and attached bearing caps for rigidly supporting said crankshaft in said cradle, said engine having a housing for rotatably supporting said cradle, wherein said webbing rigidly joins said eccentric members, and said housing slidably supports each of said bearing caps and said primary member thereby providing rigid support of said crankshaft main bearings.

2. The variable compression ratio mechanism of claim 1, wherein said primary member is a one-piece metal casting.

3. The variable compression ratio mechanism of claim 2, wherein all of said crankshaft main bearings are mounted between said eccentric members and said removable bearing camps.

4. The variable compression ratio mechanism of claim 1, wherein said engine has a crankshaft rotational speed, a mean effective pressure, and a first engine setting having a rotational speed between 1200 and 6000 rotations per minute and a mean effective pressure less than 500 kilopascals, said cradle comprises two or more bearings supporting the crankshaft, said bearings including a first bearing having a first centerline axis and a second bearing having a second centerline axis, wherein said first centerline and said second centerline are no. more than 0.008 inches apart from one another during operation of said engine at said first engine setting.

5. The variable compression ratio mechanism of claim 3, wherein said connecting rod has a swept path and said pivot axis passes through said swept path.

6. The variable compression ratio mechanism of claim 1, wherein said bearings include a first bearing mounted on a first bearing support on said cradle, said first bearing has an effective diameter and said first bearing support has an outer diameter, said cradle being pivotally supported on said outer diameter, wherein the ratio of said first bearing effective diameter to said first bearing support outer diameter is at least 0.30 thereby providing a rigid cradle having a small inertia and a fast response.

7. The variable compression ratio mechanism of claim 3, wherein each bearing caps is attached exclusively to one eccentric member, said bearing caps not being joined to one another, thereby providing clearance for the swept path of the crankshaft.

8. The variable compression ratio mechanism of claim 3, comprising at least two of said cylinders, at least three eccentric members, and at least three of said bearings, wherein said webbing rigidly connects said eccentric members to one another.

9. The variable compression ratio mechanism of claim 3, wherein, during the operation of the engine, the movement of the connecting rod defines a connecting rod swept path, said webbing being entirely outside said connecting rod swept path.

10. The variable compression ratio mechanism of claim 9, wherein said engine has one or more pistons each having a translation axis, a centerline axis for the one or more translation axes, a first plane originating at said pivot axis and passing through said centerline axis, said first plane and said centerline axis being perpendicular, a second plane originating at said pivot axis, said second plane being separated from said first plane by 20 degrees, and a third plane originating at said pivot axis, said third plane and said first plane being separated by 20 degrees, and said second plane and said third plane being separated by 40 degrees, said connecting rod swept path being bound by a fourth and a fifth plane, said fourth and said fifth planes being perpendicular to the rotational axis of the crankshaft, a clearance zone bound by the second plane and the third plane and by the fourth plane and the fifth plane, wherein said webbing is located entirely outside of said clearance zone, whereby said cradle has a mechanical clearance, a low inertia, and a fast response.

11. The variable compression ratio mechanism of claim 3, wherein said crankshaft has a crank throw having a stroke, and said cradle has a maximum thickness between a first circle and a second circle, said first circle having a center on the rotational axis of the crankshaft and having a diameter of 1.2 times said stroke, said second circle having a center on the rotational axis of the crankshaft and having a diameter of 2.0 times said stroke, said maximum thickness is at least 0.10 times the length of said stroke thereby providing a rigid cradle.

12. The variable compression ratio mechanism of claim 3, wherein said crankshaft has a crank throw having a stroke, and said cradle has a maximum thickness on a plane perpendicular to the rotational axis of the crankshaft and passing through the crank throw, said maximum thickness is at least 0.10 times the length of said stroke thereby providing a rigid cradle.

13. The variable compression ratio mechanism of claim 1, wherein said engine has a crankshaft rotational speed, a mean effective pressure, and a first engine setting having a rotational speed between 1200 and 6000 rotations per minute and a mean effective pressure less than 500 kilopascals, said cradle comprises no more than two bearings supporting the crankshaft, said bearings including a first bearing having a first centerline axis and a second bearing having a second centerline axis, wherein said first centerline and said second centerline are no more than 0.040 inches apart from one another during operation of said engine at said first engine setting.

14. The variable compression ratio mechanism of claim 13, wherein said bearings are rolling element bearings.

15. The variable compression ratio mechanism of claim 1, wherein said engine has a crankshaft rotational speed, a mean effective pressure, and a first engine setting having a rotational speed between 1200 and 6000 rotations per minute and a mean effective pressure less than 500 kilopascals, said bearings include a first bearing mounted on a first bearing support on said cradle and a second bearing mounted on a second bearing support on said cradle, wherein said first bearing support is twisted about said pivot axis relative to said second bearing support by no more than one degree of rotation at said first engine setting.

16. The variable compression ratio mechanism of claim 1, wherein said cradle has an outer surface, said actuator comprises a hydraulic working fluid, and said hydraulic fluid acts on said outer surface.

17. The variable compression ratio mechanism of claim 2, wherein said cradle further comprises an oil feed line having an oil inlet, a first main bearing and a second main bearing, wherein said oil inlet is in fluid communication with said first main bearing and said second main bearing through said oil feed line, and said oil feed line is located in said webbing between said eccentric main bearing supports.

18. The variable compression ratio mechanism of claim 17, wherein said oil feed inlet is located on said pivot axis.

19. The variable compression ratio mechanism of claim 1, wherein said cradle further comprises an oil feed line having an inlet, and a plurality of main bearings in fluid communication with said oil feed line, wherein said oil feed inlet is located on said pivot axis.

20. The variable compression ratio mechanism of claim 1, further comprising locking means for retaining the cradle in a fixed rotational position, said locking means comprises a first hydraulic actuator for exerting a clockwise moment on the cradle about the pivot axis, and a second hydraulic actuator for exerting a counterclockwise moment on the cradle about the pivot axis, a hydraulic working fluid, and a check valve for admitting and retaining said working fluid in said first hydraulic actuator.

21. The variable compression ratio mechanism of claim 1, further comprising locking means for retaining the cradle in a fixed rotational position, said locking means comprises a first hydraulic actuator for preventing clockwise rotation of the cradle, and a second hydraulic actuator for preventing counterclockwise rotation of the cradle.

22. The variable compression ratio mechanism of claim 21, further comprising a check valve for admitting hydraulic fluid into said first hydraulic actuator for reducing the rotational play of the cradle about the pivot axis.

23. The variable compression ratio mechanism of claim 21, wherein said first hydraulic actuator and said second hydraulic actuator are rotary actuators having a common axis of rotation.

24. A variable compression ratio mechanism for an engine having at least one cylinder, a piston mounted for reciprocating movement in the cylinder, a crankshaft defining an axis about which the crankshaft rotates, and a connecting the piston to the crankshaft, comprising;

a rigid crankshaft cradle supporting the crankshaft for rotation of the crankshaft about the rotational axis of the crankshaft, the cradle being mounted in the engine for pivoting relative to the engine about a pivot axis, the pivot axis being substantially parallel to and spaced from the rotational axis of the crankshaft, an actuator for varying the position of the cradle about the pivot axis for varying the position of the rotational axis of the crankshaft, said cradle comprising a first eccentric member and a second eccentric member, and first eccentric member having a first main bearing mounted on said rotational axis, and said second eccentric member having a second main bearing mounted on said rotational axis, and a fastener for rigidly connecting said first eccentric member and second eccentric members to one another, said first eccentric member further including a first main bearing bore for retaining a first crankshaft main bearing, said main bearing bore being located in a single contiguous portion of said first eccentric member, wherein said single contiguous portion fully surrounds said main bearing bore, wherein said first main bearing is spaced apart from said second main bearing along the rotational axis of the crankshaft, and said first eccentric member is spaced apart from said second eccentric member along the rotational axis of the crankshaft.

25. The variable compression ratio mechanism of claim 24, wherein said actuator comprises a connecting rod and said fastener includes a connecting rod journal, said journal connecting said connecting rod and said cradle.

26. The variable compression ratio mechanism of claim 24, wherein said cradle has an outer surface, said actuator comprises a hydraulic working fluid, and said hydraulic fluid acts on said outer surface.

27. A variable compression ratio mechanism having a housing, at least one cylinder, a piston mounted for reiprocating movement in the cylinder, a crankshaft defining an axis about which the crankshaft rotates, and a connecting rod connecting the piston to the crankshaft, comprising:

a rigid cradle supporting the crankshaft for rotation of the crankshaft about the rotational axis of the crankshaft, the cradle being mounted in the housing for pivoting relative to the housing an arcuate distance about a pivot axis being substantially parallel to and spaced from the rotational axis of the crankshaft;

said cradle comprises a first eccentric member, a second eccentric member, and webbing rigidly connecting said first and second eccentric members to one another;

said connecting rod defining a connecting rod swept path, said webbing being entirely outside said connecting rod swept path;

bearings supporting the crankshaft for rotation, said bearings being mounted on said cradle; and an actuator for varying the position of the cradle about the pivot axis, whereby the rotational axis of the crankshaft is rotated about the pivot axis of the cradle said arcuate distance and the compression ratio is varied.

28. A powering output coupling for a variable compression ratio mechanism having a housing, at least two pivotable, eccentric main bearing supports, a crankshaft, and an actuator for pivoting said main bearing supports, said main bearing supports being pivotably mounted in said housing about a pivot axis, said main bearing supports having a first pivot position and a second pivot position, said crankshaft being mounted in said main bearing supports on a crankshaft axis spaced from and substantially parallel to said pivot axis, said actuator being operable to pivot said main bearing supports from said first pivot position to said second pivot position and for moving said crankshaft axis from a first axial position to a second axial position, comprising at least one external power take-off gear on said crankshaft, and a power shaft having an axis of rotation and an external power input gear, wherein said external power take-off gear is engaged with said external power input gear, said first axial position has a first distance from said power shaft axis of rotation at said first pivot position of said bearing supports, said second axial position of said crankshaft axis has a second distance from said power shaft axis of rotation at said second pivot position of said bearing supports, and said second distance is greater than said first distance.

29. The power output coupling of claim 28, further having one or more pistons each having a translation axis, a centerline axis for the one or more translation axes, and one or more connecting rods connecting the one or more pistons to the crankshaft;

a first plane passing through said pivot axis and perpendicular to said centerline axis, a first crankshaft axis located approximately on said first plane, said centerline axis and said crankshaft axis being on the same side of said pivot axis, a second plane passing through said first crankshaft axis, said second plane and said first plane being separated by 45°, and a third plane passing through said first crankshaft axis, said third plane and said first plane being separated by 45° and said second plane and said third plane being separated by 90°, wherein said power shaft is located between said second plane and said third plane, thereby minimizing the maximum backlash between said external power take-off gear and said external power input gear.

* * * * *